US012304707B2

(12) United States Patent
Hoefte et al.

(10) Patent No.: US 12,304,707 B2
(45) **Date of Patent: *May 20, 2025**

(54) DETERGENT PRODUCT CONTAINER WITH LOCK

(71) Applicant: The Procter & Gamble Company, Cincinnati, OH (US)

(72) Inventors: Paulus Antonius Augustinus Hoefte, Astene (BE); Clara Sophie Lea Ng Pak Leung, Astene (BE); Joost Peter Leflere, Mechelen (BE); Robby Renilde Francois Keuleers, Lippelo (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/541,249

(22) Filed: Dec. 15, 2023

(65) Prior Publication Data

US 2024/0116669 A1 Apr. 11, 2024

Related U.S. Application Data

(63) Continuation of application No. 17/313,060, filed on May 6, 2021, now Pat. No. 11,932,468.

(30) Foreign Application Priority Data

May 8, 2020 (EP) ..... 20173780

(51) Int. Cl.
*B65D 5/68* (2006.01)
*B65D 85/00* (2006.01)

(52) U.S. Cl.
CPC ..... *B65D 5/68* (2013.01); *B65D 85/70* (2013.01)

(58) Field of Classification Search
CPC ..... B65D 5/685; B65D 5/38; B65D 5/4608; B65D 5/2025; B65D 5/22; B65D 5/541
(Continued)

(56) References Cited

U.S. PATENT DOCUMENTS 158,106 A * 12/1874 McGurk ..... B65D 50/045 70/289
944,063 A * 12/1909 Warren ..... B65D 5/5016 229/120.08

(Continued)

FOREIGN PATENT DOCUMENTS

AT 334276 B 1/1976
CH 710519 A2 6/2016

(Continued)

OTHER PUBLICATIONS

All Office Actions, U.S. Appl. No. 16/988,767, filed Aug. 10, 2020.

(Continued)

*Primary Examiner* — Steven A. Reynolds
*Assistant Examiner* — Prince Pal
(74) *Attorney, Agent, or Firm* — Gary J. Foose; Andrew J. Mueller

(57) ABSTRACT

A consumer product that includes a detergent product and a container, the container including a box, a lid for the box, and a lock to maintain the lid in a closed position, the box comprising the detergent product, and the lock having an actuator moveable from a locking position to an opening position.

20 Claims, 9 Drawing Sheets

(58) Field of Classification Search
USPC ..... 206/468, 530–539, 1.5; 229/125.125; 220/215, 323
See application file for complete search history.

(56) References Cited

U.S. PATENT DOCUMENTS 1,130,271 A * 3/1915 Hammond ..... B65D 5/685 206/815
1,198,792 A * 9/1916 Tracy ..... B65D 85/324 206/521.1
1,308,058 A * 7/1919 Evers ..... B65D 5/28 229/190
1,451,612 A * 4/1923 Hausner ..... B65D 5/68 24/DIG. 11
1,664,308 A * 3/1928 Miller ..... B65D 5/4295 119/490
1,682,449 A * 8/1928 Vest ..... B65D 5/4204 229/125.125
1,998,717 A * 4/1935 Guyer ..... B65D 5/543 229/145
2,251,283 A * 8/1941 Johnson ..... B65D 75/5888 229/210
2,361,852 A * 10/1944 Locke, Jr. ..... B65D 5/38 229/122
2,388,168 A * 10/1945 Marx ..... B65D 5/38 229/122
2,474,523 A * 6/1949 Reynolds ..... B65D 5/542 229/920
2,745,589 A * 5/1956 Daly ..... B65D 5/685 229/125.26
2,777,630 A * 1/1957 Moberger ..... B65D 43/0222 229/125.28
2,836,343 A * 5/1958 Will ..... B65D 5/543 229/146
2,854,184 A * 9/1958 Heine ..... B65D 5/541 229/244
2,970,742 A * 2/1961 Fleisig ..... B65D 5/685 229/921
3,055,362 A 9/1962 Huybert
3,107,008 A * 10/1963 Margulies ..... B65D 85/1036 206/267
3,116,007 A 12/1963 Esposito et al.
3,245,580 A * 4/1966 Campanella ..... B65D 11/12 221/34
3,332,600 A * 7/1967 Guernsey ..... B65D 5/38 229/125.125
3,366,496 A * 1/1968 Bomar ..... B65D 5/4295 426/410
RE26,557 E 3/1969 Houston
3,512,699 A * 5/1970 Wilson ..... B65D 5/0227 229/102
3,695,504 A * 10/1972 Simpson ..... B65D 5/727 229/125.02
3,709,402 A * 1/1973 Templeton ..... A47K 10/42 221/33
3,734,390 A * 5/1973 Buttery ..... B65D 5/28 229/151
3,734,392 A * 5/1973 Clark ..... B65D 5/685 229/174
3,752,301 A * 8/1973 Bluemel ..... B65D 5/5045 206/583
3,910,486 A * 10/1975 Stone ..... B65D 5/5425 229/145
3,915,370 A * 10/1975 Wilson ..... B65D 5/0254 229/122.34
4,007,828 A * 2/1977 Mayled ..... B65D 11/12 220/8
4,053,100 A 10/1977 Baptist
4,083,455 A * 4/1978 Keating, Jr. ..... B65D 5/5405 229/226
4,196,843 A * 4/1980 Garmon ..... B65D 5/685 229/165
4,254,903 A * 3/1981 Kuehlhorn ..... B65D 5/302 229/185
4,284,204 A * 8/1981 Carey, Jr. ..... B65D 5/38 220/8
4,289,239 A * 9/1981 Meyers ..... B65D 5/5415 229/226
4,304,355 A * 12/1981 Sykora ..... B65D 5/68 229/125.26
4,340,170 A * 7/1982 Montealegre ..... B65D 5/4608 229/920
4,341,338 A * 7/1982 Arnold ..... B65D 5/443 229/199
4,392,605 A * 7/1983 Backman ..... B65D 5/38 229/101
4,421,236 A * 12/1983 Lowe ..... B65D 5/701 229/231
4,441,648 A * 4/1984 Portsmouth ..... B65D 5/18 383/122
4,447,004 A * 5/1984 House ..... B65D 5/4608 229/164
4,582,199 A * 4/1986 Schuster ..... B65D 5/46192 206/427
4,717,070 A * 1/1988 Taub ..... B65D 5/685 229/117.16
4,746,008 A * 5/1988 Heverly ..... B65D 55/02 220/837
4,834,255 A 5/1989 Boots
4,892,247 A * 1/1990 Dirksing ..... B65D 15/22 229/125.32
5,040,722 A * 8/1991 Fromion ..... B65D 5/6667 229/148
5,050,794 A * 9/1991 Wischusen, III ..... B65D 5/248 229/179
5,103,972 A * 4/1992 Ackeret ..... B42F 7/14 229/120.08
5,148,973 A * 9/1992 Zimmermann ..... B65D 5/685 229/125.26
5,161,734 A * 11/1992 Ruehl ..... B65D 5/5415 229/223
5,222,658 A * 6/1993 DeMaio ..... B65D 71/36 206/427
5,236,123 A * 8/1993 Stone ..... B65D 5/542 229/117.31
5,265,799 A * 11/1993 Stone ..... B65D 5/543 493/907
5,299,732 A * 4/1994 Armor ..... B65D 5/46024 229/117.22
5,320,279 A * 6/1994 Giblin ..... B65D 5/542 229/117.22
5,351,819 A * 10/1994 Varon ..... B65D 5/48024 206/534
5,373,960 A * 12/1994 Gunn ..... B65D 5/46024 229/917
5,429,243 A * 7/1995 Woelk ..... B65D 5/4237 220/531
5,439,133 A * 8/1995 Stone ..... B65D 5/543 229/917
5,450,998 A * 9/1995 Esse ..... B65D 5/32 229/122.34
5,505,369 A * 4/1996 Taliaferro ..... B65D 5/4608 229/125.32
5,505,374 A * 4/1996 Stone ..... B65D 5/5415 493/162
5,515,996 A * 5/1996 Stone ..... B65D 5/6608 229/125.26
5,518,172 A * 5/1996 Nanno ..... B65D 5/0272 229/148
5,542,540 A * 8/1996 Knapp ..... B65D 85/36 206/521
5,551,938 A * 9/1996 Stone ..... B65D 5/5425 493/930
5,562,227 A * 10/1996 Takezawa ..... B65D 5/5021 229/109
5,627,150 A * 5/1997 Peterson ..... A47L 15/4436 510/439

(56) References Cited

U.S. PATENT DOCUMENTS 5,725,144 A * 3/1998 Stone ..... B65D 5/6608 229/101
5,873,516 A * 2/1999 Boggs ..... B65D 5/66 229/120.32
5,911,359 A * 6/1999 Stone ..... B65D 5/6608 229/234
5,938,031 A * 8/1999 Woods ..... G03D 15/001 206/455
6,149,030 A * 11/2000 Lemaire ..... B65D 25/46 221/92
6,158,623 A * 12/2000 Benavides ..... A47G 19/24 222/129
6,168,073 B1 * 1/2001 Towle ..... B65D 5/38 229/122
6,209,785 B1 * 4/2001 Ben-Haim ..... B65D 5/541 206/542
6,296,175 B1 10/2001 Dixon
6,484,931 B1 * 11/2002 Hofte ..... B65D 5/6608 229/149
6,604,676 B2 * 8/2003 Giblin ..... B65D 5/543 229/148
6,672,474 B2 * 1/2004 May ..... A47K 10/46 221/102
6,749,108 B2 * 6/2004 Naughton ..... B65D 5/005 229/199
D499,022 S * 11/2004 Sun ..... D9/432
7,299,968 B2 * 11/2007 Mittmann ..... B65D 5/38 229/913
7,377,385 B2 * 5/2008 Giannini ..... B65D 85/1072 229/125.125
D584,053 S * 1/2009 Abdo ..... D3/302
7,473,215 B2 * 1/2009 Moen ..... B65D 5/323 493/128
7,658,318 B2 * 2/2010 Walsh ..... B65D 5/744 229/231
7,726,552 B2 * 6/2010 Chadima ..... B65D 5/685 232/1 D
7,798,321 B2 * 9/2010 Wynalda, Jr. ..... G11B 33/0411 220/345.5
7,841,512 B2 * 11/2010 Westerman ..... B65D 5/6697 229/149
8,100,321 B2 * 1/2012 Ghini ..... B65D 5/728 229/220
8,443,978 B2 5/2013 Royer
8,596,520 B2 * 12/2013 Scott ..... B65D 5/24 229/941
8,746,444 B2 * 6/2014 Dehlin ..... B65D 5/38 220/345.4
8,997,979 B2 * 4/2015 Ghini ..... B65D 5/38 206/267
9,027,826 B2 * 5/2015 Bitner ..... B65B 69/00 229/235
9,475,605 B2 10/2016 Everett
9,718,589 B2 * 8/2017 Kopulos ..... B65D 43/169
9,758,286 B2 * 9/2017 Geeraert ..... B65D 85/804
9,783,335 B2 * 10/2017 Everett ..... B65D 5/2057
9,881,788 B2 1/2018 Kim et al.
9,981,788 B2 5/2018 Skinner
10,017,291 B2 * 7/2018 Smith ..... B65D 5/728
10,232,976 B2 3/2019 Waddington
10,293,983 B1 * 5/2019 Kaplan ..... B65F 1/062
10,294,445 B2 * 5/2019 Brandt Sanz ..... C11D 17/045
10,442,600 B2 * 10/2019 Waltermire ..... B31B 70/26
10,486,849 B2 * 11/2019 Parkes ..... B65D 5/6667
10,494,138 B1 * 12/2019 Velliquette ..... B65D 5/446
10,501,239 B2 * 12/2019 Dagnelie ..... B65D 43/0202
10,556,739 B2 * 2/2020 LiVigni ..... B65D 85/1081
10,604,632 B2 * 3/2020 Boswell ..... B32B 27/22
10,610,420 B2 * 4/2020 Morimoto ..... A61F 13/49011
10,633,617 B2 * 4/2020 Miracle ..... C11D 17/043
10,934,072 B2 3/2021 Lantz et al.
10,961,015 B2 * 3/2021 Bethune-Bates .... B65D 5/6691
D921,982 S * 6/2021 Gerhards ..... D9/707
11,046,476 B2 * 6/2021 Whitehurst ..... B65D 79/00
11,053,047 B2 * 7/2021 Curcic ..... G09F 3/04
11,097,867 B1 * 8/2021 Nixon ..... B65D 5/5445
11,794,947 B2 10/2023 Hoefte et al.
2002/0052302 A1 5/2002 Clark et al.
2003/0111523 A1 6/2003 Haugan
2003/0168502 A1 * 9/2003 Kisch ..... B65D 5/323 229/120.34
2003/0222130 A1 * 12/2003 Fukushima ..... B65D 5/4291 229/149
2004/0168951 A1 * 9/2004 Mackie, Jr. ..... B65D 5/5028 206/534
2004/0222109 A1 * 11/2004 Pucillo ..... B65D 5/5021 206/216
2005/0051573 A1 * 3/2005 Crosland ..... B65D 5/3621 222/105
2005/0061859 A1 * 3/2005 Hennessy ..... B65D 5/4295 229/117.08
2005/0184139 A1 * 8/2005 Gasior ..... B65D 5/52 206/774
2005/0241966 A1 * 11/2005 Giannini ..... B65D 5/38 206/499
2006/0118451 A1 * 6/2006 Edwards ..... B65D 75/42 206/525.1
2006/0231602 A1 * 10/2006 Mu ..... B65D 5/302 229/125.015
2007/0039840 A1 * 2/2007 Mu ..... B65D 5/4295 206/278
2007/0074988 A1 * 4/2007 Cargile ..... B65D 5/4608 206/427
2007/0221717 A1 * 9/2007 Burke ..... A47G 21/001 229/160.1
2008/0014392 A1 * 1/2008 Ayats ..... A01N 25/10 264/241
2008/0054059 A1 * 3/2008 Chadima ..... B65D 5/685 229/102
2008/0265008 A1 * 10/2008 Holley ..... B65D 5/54 229/117.14
2008/0265010 A1 10/2008 Montague
2009/0001145 A1 * 1/2009 Hasse ..... B65D 5/662 229/149
2009/0026252 A1 * 1/2009 Elliston ..... B65D 5/705 229/215
2009/0032575 A1 2/2009 D'Amato
2009/0039078 A1 * 2/2009 Sanfilippo ..... B65B 61/186 220/4.27
2009/0302097 A1 * 12/2009 Vincent ..... B65D 5/0254 229/120.33
2010/0065621 A1 * 3/2010 Quaintance ..... B65D 5/6629 229/191
2010/0089935 A1 * 4/2010 Heilman ..... B65D 47/0871 220/833
2010/0279913 A1 * 11/2010 Larrson ..... C11D 17/045 510/224
2011/0049229 A1 * 3/2011 Gillespie ..... B65D 5/543 493/162
2011/0114714 A1 * 5/2011 Sullivan ..... B65D 5/5425 229/117.3
2011/0127271 A1 * 6/2011 Jaworski ..... C11D 17/0073 220/500
2011/0204087 A1 * 8/2011 Kopulos ..... B65D 21/0219 220/810
2011/0220707 A1 * 9/2011 Solimini ..... B65D 77/065 229/117.35
2011/0266335 A1 * 11/2011 Glowacki ..... B65D 5/62 493/162
2012/0070106 A1 * 3/2012 Camargo-Parodi ..... B65D 75/5805 383/106
2012/0074823 A1 * 3/2012 Bezich ..... B65D 25/2897 29/401.1
2012/0085817 A1 * 4/2012 Gatrost ..... B65D 5/5445 493/84
2012/0279889 A1 * 11/2012 Fischer ..... B65D 5/38 206/462

(56) References Cited

U.S. PATENT DOCUMENTS

2013/0140201 A1* 6/2013 Ghini ..... B65D 85/1036 206/267
2013/0193197 A1* 8/2013 Low ..... B65D 5/308 229/146
2014/0061328 A1* 3/2014 Haymond ..... B65D 43/02 239/6
2014/0238889 A1* 8/2014 Sunder ..... C11D 3/50 53/445
2014/0305832 A1* 10/2014 Andersson ..... B65D 5/728 229/125.125
2015/0014404 A1* 1/2015 Iwata ..... B65D 5/662 229/160.1
2015/0050627 A1* 2/2015 Danchisin ..... A61Q 11/00 434/262
2015/0060538 A1* 3/2015 Laughman ..... B65D 5/48014 229/242
2015/0136637 A1* 5/2015 Meier ..... B65D 75/54 53/415
2015/0175292 A1* 6/2015 McCullough ..... B65D 5/22 229/114
2015/0183548 A1* 7/2015 Cho ..... B65D 5/546 206/503
2015/0197386 A1* 7/2015 Chang ..... B65D 5/64 206/514
2015/0210424 A1* 7/2015 Bevier ..... B65D 5/726 206/774
2015/0232785 A1 8/2015 Paullin et al.
2015/0267155 A1* 9/2015 Brooker ..... C11D 17/043 8/137
2015/0284182 A1* 10/2015 Kelly ..... B65D 90/48 206/459.1
2015/0336729 A1* 11/2015 McIntire ..... B65D 59/04 206/462
2016/0001937 A1* 1/2016 Skinner ..... B65D 5/38 206/1.5
2016/0096650 A1* 4/2016 Jamison ..... B65D 5/445 229/199
2016/0122445 A1 5/2016 Nambiar et al.
2016/0137338 A1* 5/2016 Oliveira ..... B65D 5/06 229/117.14
2016/0152373 A1* 6/2016 Linssen ..... B65D 5/38 206/1.5
2016/0167830 A1* 6/2016 Riva ..... B65D 5/744 229/125.04
2016/0214758 A1* 7/2016 Yamamura ..... B65D 5/4266
2016/0229599 A1* 8/2016 Rogers ..... B65D 51/20
2016/0236839 A1* 8/2016 Glinert ..... B65D 5/5206
2016/0251107 A1 9/2016 Everett
2017/0001752 A1* 1/2017 Ishikawa ..... B65D 5/64
2017/0008664 A1* 1/2017 Parkes ..... B65D 5/6667
2017/0036808 A1* 2/2017 Everett ..... B65D 5/38
2017/0066999 A1* 3/2017 Brandt-Sanz ..... C11D 3/222
2017/0096257 A1* 4/2017 Scott ..... B65D 5/48014
2017/0158374 A1* 6/2017 Spivey, Sr. ..... B65D 5/40
2017/0267398 A1* 9/2017 Couture ..... B31B 50/48
2017/0298308 A1* 10/2017 Labeque ..... B65D 43/22
2017/0349341 A1* 12/2017 Girardot ..... B65D 50/043
2017/0355934 A1* 12/2017 Courchay ..... C11D 17/042
2017/0355935 A1* 12/2017 Courchay ..... C11D 17/045
2017/0355937 A1* 12/2017 Courchay ..... C11D 1/04
2017/0355938 A1* 12/2017 Lee ..... C11D 17/044
2018/0020876 A1* 1/2018 Herlin ..... B65D 51/247 229/123.1
2018/0022498 A1 1/2018 Everett
2018/0134454 A1* 5/2018 De Wilde ..... B65D 43/22
2018/0134466 A1* 5/2018 Oliveira ..... B65D 43/166
2018/0134467 A1* 5/2018 Dagnelie ..... B65B 7/2842
2018/0148214 A1* 5/2018 Abe ..... B65D 33/20
2018/0162587 A1* 6/2018 Bressan ..... B65D 5/0254
2018/0215513 A1* 8/2018 Perek ..... B65D 43/22
2018/0228189 A1* 8/2018 Bandoh ..... B65D 81/3453
2018/0257827 A1* 9/2018 Drosos ..... B65D 50/066
2018/0265816 A1 9/2018 Lintula
2018/0282671 A1* 10/2018 Meier ..... B65D 75/324
2018/0282672 A1* 10/2018 Meier ..... C11D 17/045
2018/0282673 A1* 10/2018 Meier ..... B65D 65/46
2018/0334297 A1* 11/2018 De Wilde ..... B65D 43/163
2018/0346846 A1 12/2018 Kropf et al.
2019/0017001 A1* 1/2019 Camire ..... C11D 17/08
2019/0023448 A1 1/2019 Mehta
2019/0062023 A1 2/2019 Lantz
2019/0112563 A1* 4/2019 Piorkowski ..... C11D 1/83
2019/0135503 A1* 5/2019 De Wilde ..... B65D 50/046
2019/0136153 A1 5/2019 Dicosimo et al.
2019/0153364 A1* 5/2019 Green ..... C11D 17/045
2019/0185893 A1 6/2019 Guan et al.
2019/0202942 A1 7/2019 Lu et al.
2019/0270953 A1* 9/2019 Piorkowski ..... C11D 3/43
2019/0284507 A1* 9/2019 Ure ..... C11D 3/3796
2019/0291917 A1* 9/2019 Curcic ..... B65C 3/18
2019/0316066 A1* 10/2019 Ellson ..... C11D 17/043
2019/0344927 A1* 11/2019 Ozgercel ..... B65D 5/22
2019/0376010 A1* 12/2019 Salaam ..... C11D 17/042
2019/0390138 A1 12/2019 Sivik et al.
2020/0002646 A1 1/2020 Huang et al.
2020/0131457 A1* 4/2020 Depoot ..... C11D 3/43
2020/0270011 A1* 8/2020 Friton ..... B65D 5/2057
2020/0308515 A1* 10/2020 Vitiello ..... B32B 27/306
2020/0308516 A1* 10/2020 Vitiello ..... B65D 65/46
2020/0362275 A1* 11/2020 Vitiello ..... C08F 216/06
2020/0362277 A1* 11/2020 Meier ..... B65B 51/14
2021/0047072 A1* 2/2021 Ng Pak Leung .... B65D 5/4608
2021/0102147 A1* 4/2021 Meier ..... C11D 17/045
2021/0163860 A1* 6/2021 Meier ..... C11D 3/42
2021/0229855 A1* 7/2021 Stout ..... B65D 5/545
2021/0269191 A1* 9/2021 Peterson ..... B65D 83/76
2021/0347524 A1* 11/2021 Hoefte ..... B65D 5/68
2021/0371172 A1* 12/2021 Markarian ..... B65D 59/04
2022/0009671 A1* 1/2022 Hoefte ..... B65D 5/68
2022/0081155 A1* 3/2022 Hoefte ..... B65D 5/4266
2022/0185534 A1 6/2022 Hoefte et al.
2022/0289436 A1* 9/2022 Hoefte ..... B65D 5/48014
2022/0315297 A1* 10/2022 Zirollo ..... B65D 5/0227
2022/0380086 A1 12/2022 Hoefte et al.
2023/0103439 A1 4/2023 Hoefte et al.
2023/0110630 A1* 4/2023 Hoefte ..... B65B 5/024 206/525
2023/0132541 A1 5/2023 Hoefte et al.
2023/0227186 A1* 7/2023 Ruers ..... B65B 1/02 53/420
2023/0257141 A1* 8/2023 Ruers ..... B65B 7/2842 53/485
2023/0257145 A1 8/2023 Ruers et al.
2023/0264852 A1* 8/2023 Hoefte ..... B65D 5/6608 206/1.5
2023/0264853 A1 8/2023 Hoefte et al.
2023/0286695 A1* 9/2023 Hoefte ..... B65D 5/38
2023/0322455 A1* 10/2023 Beelen ..... B65D 55/02 220/253
2023/0331447 A1 10/2023 Hoefte et al.
2024/0002100 A1 1/2024 Hoefte et al.

FOREIGN PATENT DOCUMENTS

DE 9214914 U1 1/1993
EP 0571711 A2 12/1993
EP 1783058 A1 5/2007
EP 3587293 A1 1/2020
EP 3753856 A1 12/2020
FR 2820718 A1 8/2002
JP S54142223 U 11/1979
JP S5772244 A 5/1982
JP S58174483 U 11/1983
JP 3055362 U 10/1998
JP 2002029536 A 1/2002
JP 2006321501 A 11/2006
JP 2008037428 A 2/2008
JP 2018076095 A 4/2010
JP 6298245 B2 3/2018
JP 3216684 U 5/2018
JP 4536881 B2 12/2018

(56) References Cited

FOREIGN PATENT DOCUMENTS

| | | | |
|---|---|---|---|
| TW | 201444743 | A | 12/2014 |
| WO | 2008038189 | A1 | 4/2008 |
| WO | 2010085471 | A1 | 7/2010 |
| WO | 2011012863 | A1 | 2/2011 |
| WO | 2018022493 | A1 | 2/2018 |
| WO | 2019094406 | A1 | 5/2019 |
| WO | 2020131711 | A1 | 6/2020 |

OTHER PUBLICATIONS

All Office Actions; U.S. Appl. No. 17/313,060, filed May 6, 2021.
PCT Search Report and Written Opinion for PCT/US2021/031004 dated Jul. 15, 2021, 12 pages.
Extended EP Search Report and Written Opinion for 22185753.5 dated Nov. 10, 2022, 05 pages.
Extended European Search Report and Search Opinion for 20173780.6; dated Jun. 11, 2020; 7 pages.
https://www.youtube.com/watch?v=06TdcfRR95s, No. Known Date, pp. 3-7.
Perfumery, Practice and Principles, by Calkin and Jellinek, pub'd 1994, No. Known Date, pp. 173-174.
Photograph of adhesive fragrance strip in Persil 3-in-1 plastic tub, No. Known Date, 2 pages.
U.S. Appl. No. 18/506,351, filed Nov. 10, 2023, Henri Theo Leonie Ruers et al.

* cited by examiner

DETERGENT PRODUCT CONTAINER WITH LOCK

BACKGROUND

This invention generally relates to containers for detergent products. Such containers for detergent products are consumer products present in consumer homes and may be lifted and transported by consumers into their homes and within their homes.

DETAILED DESCRIPTION

Figure 1A:
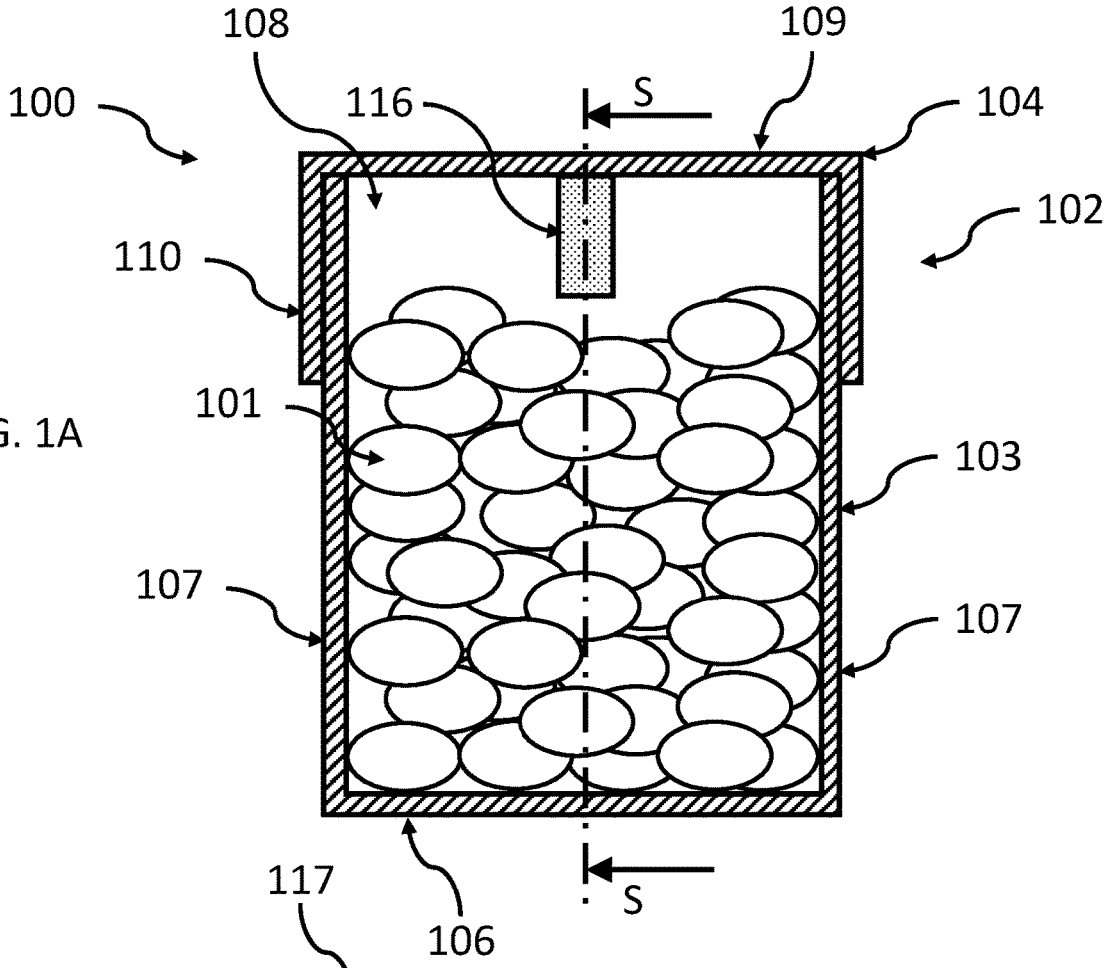
FIG. 1A-E illustrate an example consumer product.

Detergent products are products which may be relatively heavy, for example when a container for such product is carrying the full weight of such detergent products, in particular when the consumer product is recently acquired and thereby holds a significant quantity of detergent product. While some consumers may lift and transport such a consumer product holding a base of a box containing such detergent product, such lifting and transport may also occur by holding such consumer product by a lid, without holding the base. In such cases, it is possible that the lid, submitted to the force of gravity of the detergent product, gets released and opens the box, the box falling and possibly spreading its content. Such situations should be avoided. Beyond avoiding such unintentional lid unlocking, the structure of the container of a consumer product should preserve or improve opening ergonomics and prevent or reduce a permanent side wall deformation upon excessive or repetitive application of forces applied to the consumer product. At the same time, containers may be elaborated in order to preserve the environment. The consumer product according to this disclosure aims at taking these different aspects into account.

The present disclosure refers to a consumer product. A consumer product should in this disclosure be understood as a product which is provided, among others, to end consumers. Such consumer products may for example be available for purchase in supermarkets and end consumers may store such consumer products in their homes. Consumer products may be provided in large quantities and should thereby be designed taking environmental concerns into account. Consumer products should also be designed taking transportation to a retail store into account. Consumer products should also be designed taking on the shelf storage in a retail store into account. Consumer products should also be designed taking transportation from a retail store to a consumer home into account. Consumer products should also be designed taking storage at a private end consumer home into account. Consumer products should also be designed taking use of the consumer product at a private end consumer home into account. Consumer products should also be designed taking disposal into account.

The consumer product according to this disclosure comprises a detergent product. Detergent products should be understood in this disclosure as products comprising a surfactant. Detergent products may also comprise a bleach or other ingredients. Example detergent product compositions are described in more detail herein. In some examples, the detergent product comprises unit dose detergent pouches. Example unit dose detergent pouches are described in more detail herein.

The consumer product according to this disclosure further comprises a container. A container should be understood in this disclosure as an object housing a content, for example in a cavity of the container. The container facilitates protection, transport, storage, access and disposal of the consumer product. In this disclosure, the container comprises a box. A box should be understood as a generally parallelepiped, barrel shaped, cylindrical, round, oval or cubical three dimensional object defining a cavity. The use of parallelepiped boxes may facilitate storage and transportation by permitting piling up boxes in a space efficient manner. In some examples, a box may be a parallelepiped provided with some rounded, tapered trapezium or chamfered edges. The box according to this disclosure comprises the detergent product. It should be understood that the detergent product is contained or stored in the box. The box according to this disclosure comprises a base, sidewalls and an opening. A base according to this disclosure should be understood as a surface on which the box may lie when placed on a supporting surface such as a shelf or a floor. In some examples, the base is flat. In some examples, the base is rectangular. In some examples, the base is oval or round. In some examples, the base is flat. In some examples, the base has an embossed profile standing in or out in relief. The sidewalls according to this disclosure should be understood as extending from the base, and connecting the base to the opening, to a transition piece or to the lid. It should be understood that the connection of the base to the opening may include a transition piece in addition to a sidewall. A transition piece may be glued or otherwise attached to the sidewall for example. In some examples, the sidewalls are perpendicular to the base. In some examples, the base is rectangular and has four sides, four sidewalls extending perpendicular from the base, each sidewall being rectangular, each side wall being connected by a sidewall side to a side of the base, and by two other sidewall sides to two other of the four sidewalls. In some examples the base is oval or circular and the sidewalls form a generally cylindrical wall extending from the base in a direction normal or perpendicular to the base. Normal or perpendicular should be understood in this description as substantially normal or substantially perpendicular. In some examples, normal or perpendicular comprises angles of less than 120 and of more than 60 degrees. In some examples, normal or perpendicular comprises angles of less than 110 and of more than 70 degrees. In some examples, normal or perpendicular comprises angles of less than 110 and of more than 70 degrees. In some examples, normal or perpendicular comprises angles of less than 100 and of more than 80 degrees. In some examples, normal or perpendicular comprises angles of less than 95 and of more than 85 degrees. In some examples, sidewalls have a shape corresponding to one of a square, a rectangle, a trapeze, a section of a sphere, a section of an ovoid, or a section of an ellipsoid. The opening according to this disclosure should be understood as an aperture providing access to the detergent product comprised in the box. In some examples, the opening faces the base. In some examples, the opening has a surface of less than the surface of the base. In some examples, the opening has a surface larger than the surface of the base in order to provide an improved access, for example using sidewalls extending from the base at angle of more than 90 degrees from the base. In some examples, the opening is provided after removal of a tamper proof feature, for example comprising a perforated piece to be removed at first use or a tamper evident sticker locking the lid to the box or tray. In some examples, the opening is placed on a top panel of the box, the top panel of the box facing the base of the box, the top panel of the box being separated from the base of the box by at least the sidewalls, the top panel of the box being generally coplanar with the base of the box, whereby the opening covers a portion of the top panel, the top panel comprising a peripheral section surrounding the opening, the peripheral section being a transition piece between a sidewall and the opening for example. In some examples, the opening is rectangular. In some examples, the opening is rectangular with rounded edges. In some examples, the opening is round or oval. The lid according to this disclosure should be understood as an element permitting to repeatedly close or open the opening of the container. In some examples the lid may be connected to the box, for example by a hinge, or may be separated from the box. The lid according to this disclosure comprises a top and flanks. It should be understood that the top of the lid is aimed at covering the opening of the box when the lid is in a closed position. In some examples, the top of the lid is rectangular. In some examples the top of the lid is round, hexagonal, octagonal, or oval. In some examples, the lid comprises beveled edges. In some examples, the top of the lid is rectangular with rounded edges. It should be understood that while being named "top", the top of the lid may be positioned in different orientations. The lid comprises flanks. It should be understood that the flanks according to this disclosure are elements connected to the top of the lid and extending from the lid in order to engage one or more sidewalls of the box. The flanks participate in placing the top of the lid onto the opening. In some examples, the flanks extend perpendicularly from the top of the lid. In some examples, the flanks surround an entire perimeter of the top of the lid. In some examples, the flanks partially surround an entire perimeter of the top of the lid, a portion of the top of the lid being flankless. According to this disclosure, the top of the lid covers the opening, and at least a portion of the flanks covers at least a specific portion of the sidewalls when the lid is in the closed position, the lid being moveable from the closed position to an open position. Movement of the lid may be restrained by a connection to the box such as a hinge, or may be entirely removable, for example to provide an improved access to the content of the box. The box and lid cooperate to participate in fulfilling the role of the container to store, transport and facilitate access to the content of the container.

The container according to this disclosure comprises a lock. A lock should be in this disclosure understood as a mechanism preventing or reducing the likelihood of an accidental opening. The lock according to this disclosure is to maintain the lid in a closed position. It should be understood that the lock according to this disclosure is expected to function under normal use of the container. It should be understood that the lock may not fulfill its function when for example unusual use is made of the box, or when the box is under unusual conditions. According to this disclosure, the lock comprises an actuator moveable from a locking position to an opening position by applying an actuation pressure onto the actuator when the lid is in the closed position. The actuator should be understood in this disclosure as a mechanical structure submitted to a movement upon actuation by an outside force or actuation pressure, such movement leading to the opening of the lock when such movement takes place. In some examples, the actuator according to this disclosure is resilient and has a default position, such default position corresponding to the lid remaining closed, the resilience being vanquished by an outside force or actuation pressure in order to open the lid. In some examples, the actuator is resilient in that the actuator comprises a flexible element, the flexible element having a default position corresponding to the lid remaining closed, the flexible element being pressed to open the lid, the flexible element springing back to the default position when releasing pressure. It should be understood that a pressure is generated by the application of a force onto a surface. The actuator according to this disclosure has at least two positions being an opening position and a locking position, whereby the opening position corresponds to a position permitting opening of the lid, the locking position preventing opening of the lid or reducing the possibility of an accidental opening of the lid.

The actuator according to this disclosure is connected to the specific portion of the sidewalls, which is the specific portion covered by at least a portion of the flanks when the lid is in the closed position, the actuator abutting against a locking tab of the flanks when in the locking position, the actuator being maintained away from the locking tab when in the opening position, the actuator being displaceable by the actuation pressure by an unlocking displacement distance in a direction normal to the specific portion of the sidewalls. The connection of the actuator to the specific portion of the sidewall is due to the actuator participating in locking or unlocking the specific portion of the sidewall from the portion of the flanks covering the specific portion of the sidewall, thereby permitting releasing the lid from the box. The flanks comprise a locking tab. A locking tab should be understood as a mechanical element which interlocks with the actuator. In some examples the locking tab extends away from the flanks and may be in the form of a bulge, a ridge, an embossment or an additional material layer sticking out of the flanks and towards the specific portion of the side wall such that the actuator may abut against the tab when in the locking position to prevent separating the specific portion of the sidewalls from the flank in the area of the actuator. In some examples, the locking tab is comprised in the flank itself, the locking tab being for example formed by an aperture in the flanks. Abutment according to this disclosure should be understood as a contact between the actuator or part of the actuator and the tab, such contact preventing opening of the lid. The actuator is maintained away from the locking tab when in the opening position, in order to release the locking tab. Such release of the locking tab permits opening the lid. Displacement or movement of the actuator from the locking to the opening position is by application on the actuator (directly or indirectly) of an actuation pressure or force such that the actuator is displaced by a distance sufficient to supress contact of the actuator with the locking tab, such distance corresponding to the displacement distance, in a direction normal to the specific portion of the side wall. It should be understood that the force or pressure leading to the displacement may have a number of different directions, such different directions contributing to the displacement if a component of such force or pressure is in a direction normal to the specific portion of the side wall. Such force or pressure may also comprise a component which may be parallel to the side wall. The actuation is however triggered by a component of such force or pressure being normal to the portion of the side wall. Such presence of a component normal to the portion of the sidewall participates in the role of the lock of avoiding an accidental opening by lifting the container through lifting the lid by applying a force parallel to the sidewall, whereas desired opening would take place by the consumer "pushing" the actuator and apply the unlocking force or pressure permitting opening of the lid. In other words, while a consumer may apply a force on the actuator along a direction which may not be normal to the sidewall, if a component of such force is normal to the sidewall such component may participate in applying the pressure leading to the displacement.

Such a lock would participate in suppressing or reducing the risk of accidental opening of the lid while permitting desired opening by a consumer, the functioning of such a lock depending on ensuring that the actuator maintains abutting against the locking tab even in case of pulling strongly on the lid in a direction parallel to the side wall in order to transport or lift the consumer product. The avoidance or reduction of the risk of accidental opening would also apply to a force being applied in a direction parallel to the sidewalls for example by friction with another box located side to side with a box according to this disclosure, or by a box falling over during transportation, or by internal movements of the content of the box pushing the lid during transportation. Strong pulling in a direction parallel to the sidewall may however impact the structure of the sidewall, for example resulting in bending of the side wall, whereby such bending may produce undesired disengagement of the locking tab from the activator, due to the fact that the actuator is connected to the specific portion of the sidewall. This would lead to an undesired opening of the lid. Such undesired opening of the lid may be more likely if the sidewall is made of a material which is prone to bending, for example if light plastic material or cardboard is used to form the sidewalls. Such materials are however considered in some examples, in particular in some particularly environmentally friendly examples. In some examples, the box is indeed a cardboard box.

In some examples, the lock is placed in a central area of a sidewall. A central area should be understood as substantially equidistant from opposite edges of the sidewall concerned, such edges being along a direction normal to the base of the box. In such examples, it should be understood that the lock is located closest to an edge of the sidewall close to the opening than to an edge of the sidewall close to the base, while being in a central area in respect to the edges normal to the base. Such central location of the lock may participate in avoiding sliding of the lid from the box if the box is lifted by holding the lid by applying pressure onto the actuator, whereby such pressure presses the actuator against the support element centrally, thereby balancing the forces maintaining the connection between the lid and the box and participating in avoiding accidental opening. In some examples, the lock may be located on a sidewall and between two edges of the sidewall, such edges being normal to the base, the lock being closer to one edge than to the other edge of the two edges, for example located closer to the one edge at a ⅓ of the distance between the two edges. In some examples one sidewall may comprise two locks.

The present disclosure aims at resolving this apparent contradiction between, on one hand, the use of materials for the sidewalls which would resist accidental opening, and the use of materials for the sidewalls which are particularly environmentally friendly.

The container may be made from rigid material, flexible material or a mixture thereof. In some example, the material forming the box or the lid has a wall thickness of more than 300 microns and of less than 3 mm. In some example, the material forming the box or the lid has a wall thickness of more than 1 mm and of less than 2 mm. In some example, the material forming the box or the lid is folded on itself, for example to reinforce parts of or the whole of the box or the lid. The container may be made from plastic materials, metallic materials, paper materials, bio based material, bamboo fibres, or a mixture thereof. The container may be made from materials comprising recycled materials. The container may be made from a plastic material, for example a polyolefin material. The container may be made from polypropylene, polystyrene, polyethylene, high-density polyethylene, polyethylene terephthalate, polyvinyl chloride, Acrylonitrile Butadiene Styrene, Polycarbonates, Polyamides or a mixture thereof. In some examples, the container may be made from polypropylene, polystyrene, high-density polyethylene, polyethylene terephthalate, or a mixture thereof. The plastic material may have a tensile modulus ranging from 1250 MPa to 3000 MPa, for example between 1300 MPa and 2300 MPa. The container may be made from metallic materials wherein the metallic material is for example selected from aluminium, steel or a mixture thereof. The container may be made from paper or cardboard materials wherein the paper material is for example selected from paperboard, cardboard, laminates, cellulose pulp materials or a mixture thereof. The material used to make the container may comprise other ingredients, such as colorants, preservatives, plasticisers, UV stabilizers, Oxygen, perfume, recycled materials and moisture barriers or a mixture thereof. The container may comprise areas of external or internal printing. The container may be made for example by thermoforming, injection moulding, injection stretch blow moulding, extrusion, extrusion blow moulding, cardboard making, or a mixture thereof. In some specific examples, the container is made by thermoforming or injection moulding or a mixture thereof. Suitable processes include, but are not limited to, tube forming from a flat laminate with a welding step, extruded tube forming, folding or a mixture thereof. The container may be opaque, transparent, translucent, or a mixture thereof. In some examples, the container is opaque, for example to protect the content from external light. In some examples the container is constructed at least in part and in some specific examples in its entirety from paper-based material. By paper-based material, we herein mean a material comprising paper. Without wishing to be bound by theory, by 'paper' we herein mean a material made from a cellulose-based pulp. In some examples, the paper-based material comprises paper, cardboard, or a mixture thereof, wherein preferably, cardboard comprises paper-board, corrugated fiber-board, or a mixture thereof. Corrugated fiber-board comprises a series of flutes. Each flute can be understood to be a channel. The flutes run parallel to one another, with the flute direction being the direction travelled along each channel. The paper-based material may be a laminate comprising paper, cardboard, or a mixture thereof, wherein in some examples, cardboard comprises paper-board, corrugated fiber-board, or a mixture thereof, and at least another material. In some examples, the at least another material comprises a plastic material. In some examples, the plastic material comprises polyethylene, polyethylene terephthalate, polypropylene, polyvinylalcohol or a mixture thereof. A barrier material may be used as the at least another material. The barrier material may be a biaxially orientated polypropylene, a metallised polyethylene terephthalate or a mixture thereof. The at least another material may comprise a wax, a cellulose material, polyvinylalcohol, silica dioxide, casein based materials, or a mixture thereof. In some examples, the paper-based laminate comprises greater than 50%, preferably greater than 85%, and more preferably greater than 95% by weight of a laminate of fiber-based materials. In some examples, the barrier material may comprise plastic material having a thickness of between 10 micron and 40 micron. In some examples, the barrier material may comprise plastic material having a thickness of between 10 micron and 35 micron. The paper-based material may be a laminate. In some examples, the internal surface of the box and, in some examples, the lid, comprises paper, cardboard, or a mixture thereof, wherein, in specific examples, cardboard comprises paper-board, corrugated fiber-board and lamination of polyethylene, or a mixture thereof, and, in some examples, the external surface of the box, the lid or a combination thereof comprises the at least another material. Alternatively, the at least another material might also be laminated in-between two paper-based material layers. Without wishing to be bound by theory this at least another material might act as a barrier for leaked liquid absorbed by the paper-based material facing the interior side of the container, to prevent or reduce flow through the container wall and contaminating an outer wall of the container. Other structures may be found efficient to avoid leakage from the content or to protect the content from external fluids, for example from a shower or sink. Contamination of the outer wall of the container might be unsightly to consumers or may contaminate the storage area. In some examples, the box and the lid are made of a paper-based material comprising the at least another material laminated in between two corrugated fiberboard layers, and the support element is made of plane paper-board material. In some examples, the material used for the box or for the lid comprises a core cardboard flute material sandwiched between two plain cardboard layers and polyethylene laminate.

The lid according to this disclosure indeed further comprises a support element, the support element entering the opening when the lid is in the closed position, at least part of the specific portion of the sidewalls being located between the flanks and the support element when the lid is in the closed position, a clearance distance separating the sidewalls from the support element in a direction normal to the specific portion of the sidewalls when the lid is in the closed position and when no actuation pressure is applied, the clearance distance being reduced to zero by flexing of the specific portion of the sidewalls when the actuation pressure is applied above a pressure threshold when the lid is in the closed position. Both the support element and the flanks are structurally part of the lid, the support element and the flanks permitting sandwiching the specific portion of the sidewall, thereby preventing sinking in of the specific portion of the sidewall and undesired disengagement of the actuator from the locking tab. It is important to take note of the fact that in case of an actuation pressure being applied while lifting the box through the lid, the pressure applied will catch the sandwiched specific portion of the sidewall against the support element, thereby compensating a force of gravity which would otherwise disconnect the lid from the box, such compensation of the gravity force being through a resisting static friction force between the specific portion of the sidewall and the support element. In some examples, the use of the support element permits using for making the box a relatively flexible material, whereby such flexible material would flex in the absence of the support element to the point that the box would fall off if lifted by its lid. Permitting using a relatively flexible material also permits using a lesser quantity of such material due to the presence of the support element which compensates for such flexibility. The presence of such support element thereby prevents or reduces the risk of accidental opening even if the actuation pressure is applied onto the actuator of the lock, for example as the box is lifted while applying pressure on the actuator of the lock.

The support element may in some example be made of the same material as a material used for making the top of the lid. In some examples the support element is made of a material different from the material used for the top of the lid. In some examples the support element is integral with the top of the lid. In some examples, the support element is a part separate from the top of the lid and affixed to the top of the lid. The support element enters the opening when the lid is in the closed position. Such entering the opening should be understood in that the support element comprises a support element portion which enters the opening when the lid is moved from the open to the closed position, and whereby such support element portion exits the opening when the lid is moved from the closed to the open position. At least part of the specific portion of the sidewalls is located between the flanks and the support element when the lid is in the closed position. This structure permits capturing the specific portion of the sidewall between the flanks and the support element, the specific portion of the sidewall getting inserted between the flanks and the support element when the lid moves from the open to the closed position, the specific portion of the side wall being released from between the flanks and the support element when the lid moves from the closed to the open position. A clearance distance separates the sidewalls from the support element in a direction normal to the specific portion of the sidewalls when the lid is in the closed position and when no actuation pressure is applied. Such clearance permits insertion of the support element through the opening as the lid gets closed, such that the support element does not collide with the specific portion of the sidewall when the lid gets closed. The clearance is reduced to zero by flexing of the specific portion of the sidewalls when the actuation pressure is applied above a pressure threshold when the lid is in the closed position. When such pressure threshold is reached, the sidewall lays against the support element through the clearance distance being reduced to zero, the sidewall thereby being prevented from being exceedingly distorted and being prevented from sinking in to the point of the actuator releasing the locking tab. The clearance distance according to this disclosure relates in some examples to a tolerance distance between the lid and the box which both permits placing the lid onto the box without undue difficulty, while avoiding that the lid be loose when in the closed position. While the clearance distance according to this disclosure is considered in a region of the lock, the tolerance distance between the lid and the box may be considered along an entire perimeter of the opening of the box. In some examples, the tolerance is of at least 0.1 mm and of less than 5 mm. In some examples the tolerance is of at least 1 mm and of less than 3 mm Such tolerance would for example be measured when the lid is in the closed position and between an internal surface of the flanks and an external surface of the sidewalls, understanding that such tolerance may take a different value in a region of the lock.

FIGS. 1A-E illustrate an example consumer product 100 comprising a detergent product 101 and a container 102, the container 102 comprising a box 103, a lid 104 for the box 103, and a lock 105 to maintain the lid 104 in a closed position, the box 103 comprising the detergent product 101, the box 103 comprising a base 106, sidewalls 107 and an opening 108 opposite the base 106, the lid 104 comprising a top 109 and flanks 110, the top 109 covering the opening 108 and at least a portion 111 of the flanks covering at least a specific portion 112 of the sidewalls 107 when the lid is

104 in the closed position, the lid 104 being moveable from the closed position to an open position, the lock 105 comprising an actuator 113 moveable from a locking position to an opening position by applying an actuation pressure 114 onto the actuator 113 when the lid 104 is in the closed position, the actuator 113 being connected to the specific portion 112 of the sidewalls 107, the actuator 113 abutting against a locking tab 115 of the flanks 110 when in the locking position, the actuator 113 being maintained away from the locking tab 115 when in the opening position, the actuator 113 being displaceable by the actuation pressure 114 by an unlocking displacement distance in a direction normal to the specific portion 112 of the sidewalls 107, whereby the lid 104 further comprises a support element 116, the support element 116 entering the opening 108 when the lid 104 is in the closed position, at least part of the specific portion 112 of the sidewalls 107 being located between the flanks 110 and the support element 116 when the lid 104 is in the closed position, a clearance distance 117 separating the sidewalls 107 from the support element 116 in a direction normal to the specific portion 112 of the sidewalls 107 when the lid 104 is in the closed position and when no actuation pressure is applied, the clearance distance 117 being reduced to zero by flexing of the specific portion 112 of the sidewalls 107 when the actuation pressure is applied above a pressure threshold when the lid 104 is in the closed position. It is avoided to repeat the reference numerals in the Figures to avoid limiting their readability. FIG. 1A illustrates a cross section in which the lock is not visible. FIGS. 1B-E correspond to a cross section along cross section plane S illustrated in FIG. 1A. The lock 105 is visible in FIGS. 1B-E in different configurations which will be hereby described. The lid is illustrated as closed in all FIGS. 1A-E.

Figure 1B:
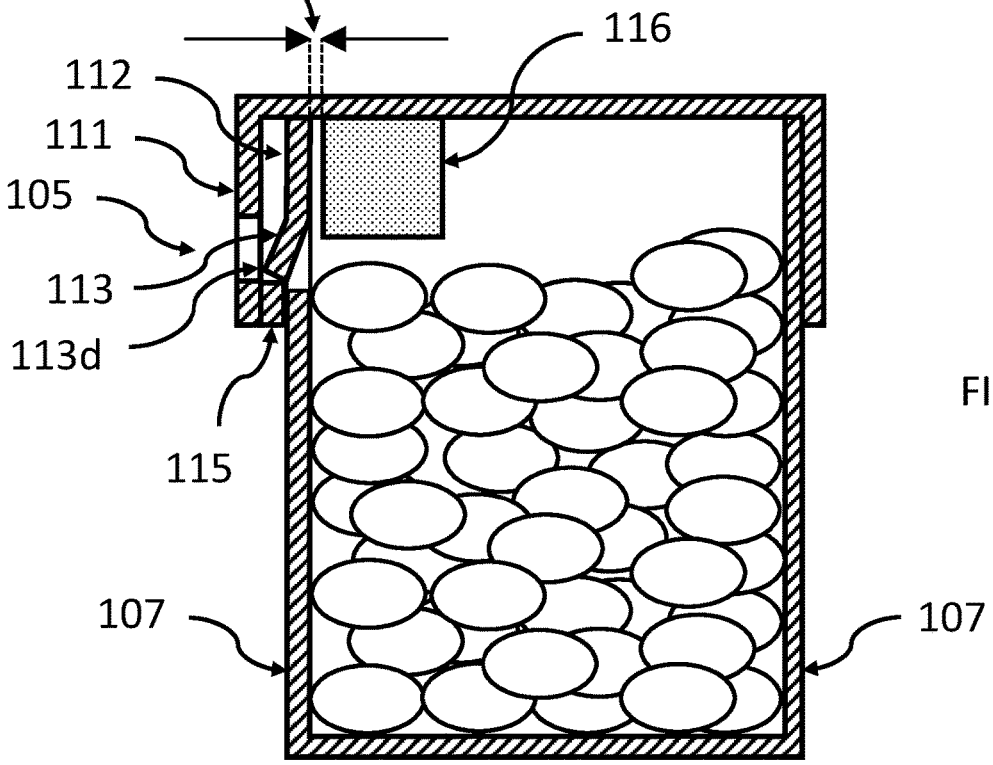
Figure 1C:
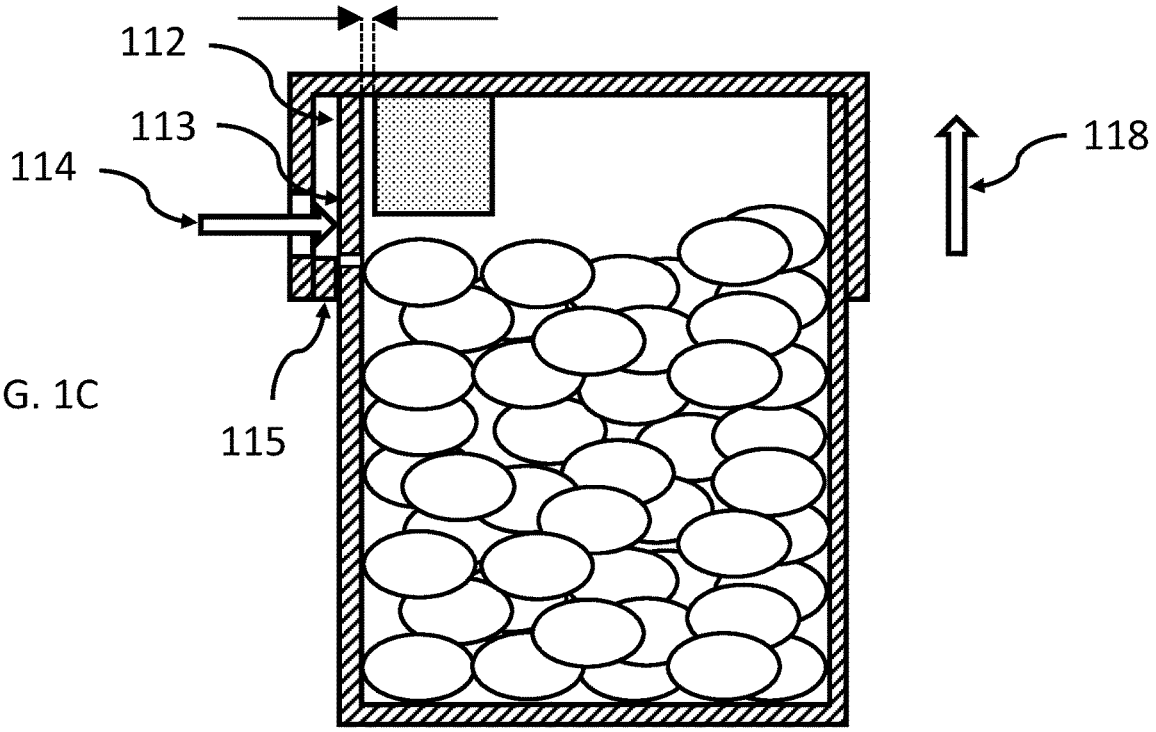
Figure 1D:
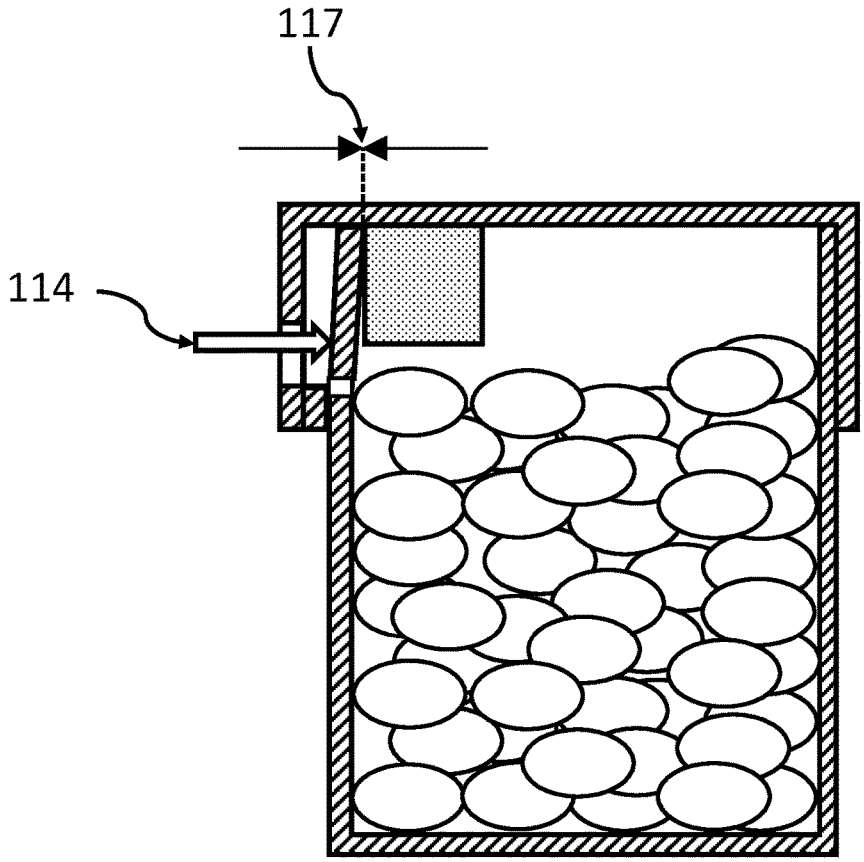
Figure 1E:
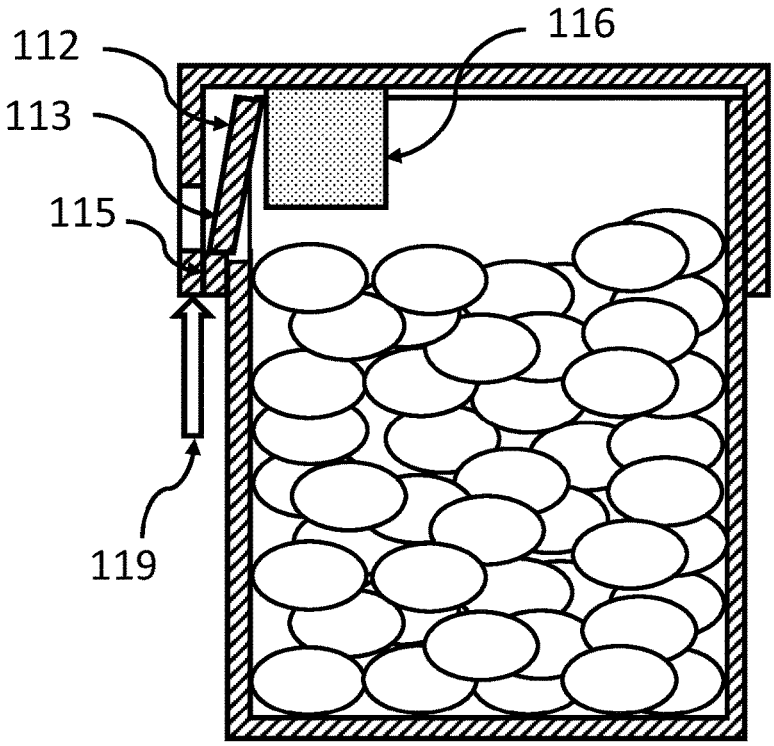

In FIG. 1B, no external or actuation pressure, force or torque is applied to the consumer product. In this situation, the actuator 113 abuts against locking tab 115. In FIG. 1C, an external pressure is applied onto the actuator, the external pressure having a component normal to the portion 112 of the sidewall illustrated by actuation pressure 114. This actuation pressure displaces the actuator 113, in this example aligning actuator 113 with the portion 112 of the sidewall, thereby releasing the locking tab 115, such that the lid may in this example slide open along direction 118 normal to the base 106 of the box. One should note that while the lid is in this example illustrated as a lid which may be pulled open along a direction normal to the base of the box, another example not illustrated here could comprise a lid connected to the box with a hinge. In FIG. 1D, the pressure applied is such that the side wall bends and lays against the support element 11, reducing clearance 117 to zero. Both FIGS. 1C and 1D illustrate a scenario whereby the lid may be open, in the case of FIG. 1D with an actuation pressure higher than the actuation pressure corresponding to FIG. 1C, In FIG. 1E, the same example as in FIGS. 1A-D is illustrated, whereby a force is applied in order to try and lift the container up by pulling the lid, the force being for example applied to transport the consumer product. In this case, the force bends the lock structure. As illustrated, due to the portion 112 of the sidewall being sandwiched between the support element and the flanks, the portion 112 of the sidewall is sustained by the support element 116 and the abutment of the actuator 113 against the locking tab 115 is maintained, thereby preventing undesired opening. In the absence of support element 116, the portion of the sidewall would sink in, and possibly lead to an undesired unlocking.

In some examples, the clearance distance is of at least 1 mm and of less than 1 cm when the lid is in the closed position and no actuation pressure is applied. Such a range permits both easing the closing of the lid and preventing sinking of the specific portion of the sidewall leading to undesired unlocking. In some examples, the clearance distance is of at least 1.5 mm and of less than 0.5 cm when the lid is in the closed position and no actuation pressure is applied. In some examples, the clearance distance is of at least 2 mm and of less than 0.4 cm when the lid is in the closed position and no actuation pressure is applied.

In some examples, as for example illustrated in FIGS. 1B to 1E, the actuator comprises a flap 113 connected by a hinge portion to the specific portion 112 of the sidewalls, the flap extending from the hinge portion to a distal edge 113*d* of the flap, the hinge portion being located between the flanks and the support element when the lid is in the closed position, the distal edge 113*d* extending away from the specific portion of the sidewalls and the distal edge 113*d* of the flap abutting against the locking tab 115 of the flanks when in the locking position, the flap lying flush against the specific portion of the sidewalls and the distal edge being maintained away from the locking tab when in the opening position (see for example FIG. 1C), the actuation pressure displacing the flap by an acute actuation angle from the closing position to the opening position, the acute angle corresponding to displacing the distal edge by the unlocking displacement distance. In some examples, the acute angle is between 5 and 60 degrees. In some examples, the acute angle is between 5 and 45 degrees. In some examples, the acute angle is between 5 and 20 degrees. In some examples the acute angle is a function of the length of the locking flap in a direction generally parallel to the specific portion and of a thickness of the locking tab and of tolerances between the sidewalls of the box and the flanks of the lid and of a tolerance between the sidewalls of the box and the flap, or patch as disclosed below. In some examples horizontal displacement (along a direction substantially normal to a sidewall comprising the specific section) measured at the end of the locking flap abutting with the locking tab is of at least a thickness of the locking tab along a direction substantially normal to a sidewall comprising the specific section. In some examples such horizontal displacement is comprised between 0.3 mm and 30 mm. In some examples a length of the flap has a length along a direction generally normal to the base of the box larger than the sum of different tolerances comprising a play between the locking tab and the flap in the abutment area when the lid is in the closed position and the container is not submitted to external pressure, a tolerance between the flanks of the lid and the sidewalls of the box, and the tolerance between the side walls of the box and the flap and a bending deformation of the flap. In some examples the locking flap has a length along a direction generally normal to the base of the box of at least 3 mm and of less than 60 mm. In some examples the locking flap has a length along a direction generally normal to the base of the box of at least 15 mm and of less than 45 mm. In some examples the locking flap has a length along a direction generally normal to the base of the box of at least 25 mm and of less than 35 mm. In some examples, the flap has a width along a direction perpendicular to its length and parallel to the specific portion of between 5 mm and 60 mm Such example width dimensions may permit easing disengaging the lock by limiting its width while avoiding a risk of the lock getting distorted by pressure by providing the lock with a sufficient width. Such dimensioning selection may be dependent on the material selected for the different parts forming the container. Such a flap may be used in examples or configurations differing from the ones illustrate in FIGS. 1B to 1E.

In some examples, not illustrated here, the actuator comprises a patch glued to the specific portion of the sidewalls. Such patch may for example be a piece of material of the same nature as a material used for the making of the box or of the lid, such piece of material being for example glued to the box, the piece of material being structurally separate from the box, the piece of material interacting with the locking tab, the piece of material comprising for example a fold line defining a first part interacting with the locking tab and a second part glued to the box, thereby functioning as the flap hereby described.

Figure 1F:
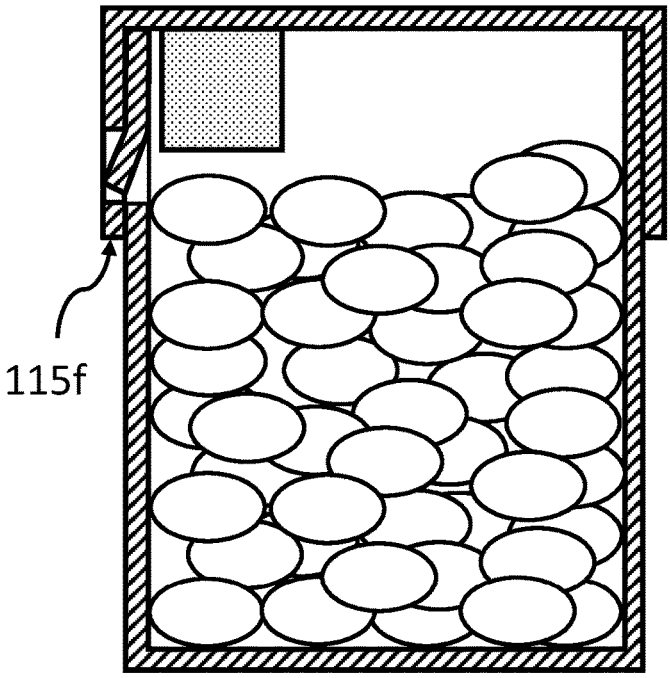
FIG. 1F illustrates a variation of the example of FIG. 1A-E

FIG. 1F illustrates an example according to this disclosure which is a variation of the structure illustrated in FIGS. 1A-E, whereby the locking tab 115*f* is formed by part of an aperture formed in the flanks of the lid, thereby avoiding having to place an additional separate element to form a locking tab such as locking tab 115 illustrated in FIGS. 1A-E.

Figure 2:
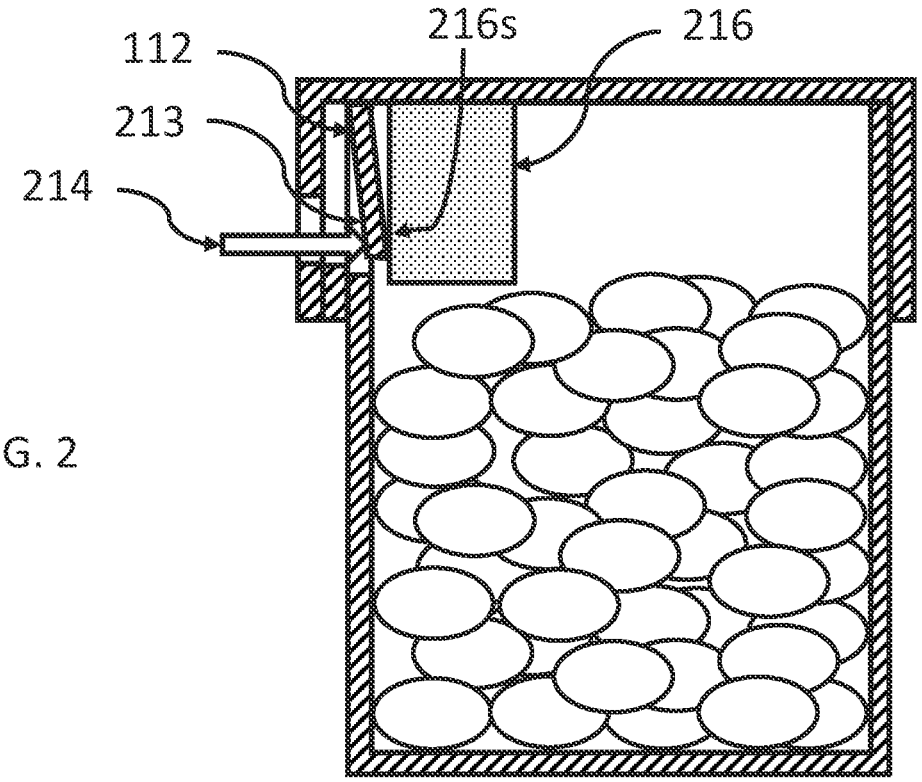
FIG. 2 illustrate another example consumer product.

In some examples such as illustrated in FIG. 2, the support element 216 comprises a support area 216*s*, the support area 216*s* comprising an area of contact with the specific portion 112 of the sidewall when the clearance is reduced to zero by flexing of the specific portion 112 of the sidewalls when the actuation pressure 214 is applied above the pressure threshold when the lid is in the closed position, whereby the area of contact faces the actuator 213 along a direction normal to the specific portion of the side walls. Bringing such area of contact at the level of the actuator permits improving the resiliency of the structure, whereby the actuation pressure will be directly absorbed by the support element once the clearance distance is reduced to zero and the actuator makes direct contact with the support element at the area of contact.

Figure 3:
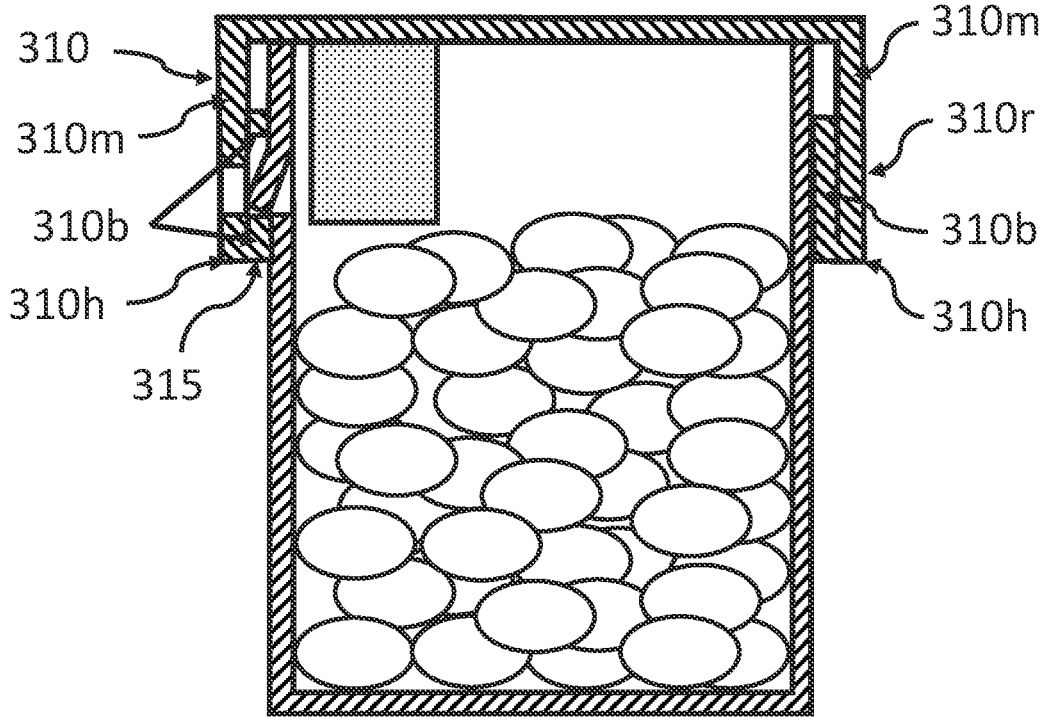
FIG. 3 illustrate a further example product.

In some examples as illustrated in FIG. 3, at least a part of the flanks 310 comprises a reinforced flank section 310*r*. In some examples, such reinforced flank section comprises a main layer and an additional layer for reinforcement. In some examples, such reinforced flank section comprises a back folded additional layer. In some examples, such additional layer is glued to a main layer of the flanks.

In some examples, either one of or both the box and the lid comprise a reinforcement area. Such reinforcement area may for example comprise a bended or folded back area. Such reinforcement area may for example comprise an additional glued material or layer. Such reinforcement area may comprise an insert or a sleeve. In some examples the reinforcement area covers specific areas of the box or lid. In some examples, the reinforcement area comprises the box base. In some examples, the reinforcement area comprises the sidewalls. In some examples, the reinforcement area comprises the flanks of the lid. In some examples, all areas of the box are reinforced. In some examples, all areas of the lid are reinforced.

In some examples as illustrated in FIG. 3, the reinforced flank section comprises the locking tab 315. As illustrated in FIG. 3, in some examples the reinforced flank section comprises a main flank section 310*m* and a folded back flank section 310*b* lying flush against the main flank section, the main flank section being hingedly connected to the folded back flank section 310*b* at an end 310*h* of the reinforced flank section distal from the top of the lid. Such flank reinforcement may contribute to reinforcing the structure of the closed container.

Figure 4A:
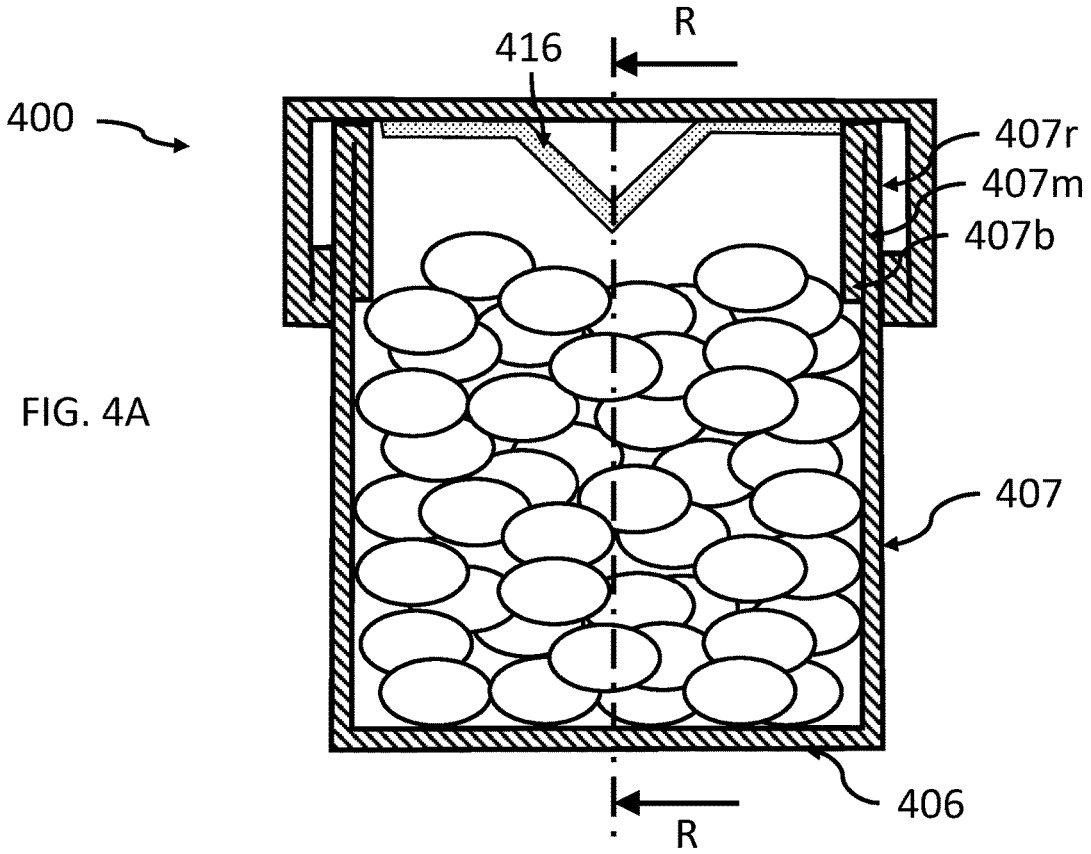
FIG. 4A-D illustrate yet another example product.
Figure 4B:
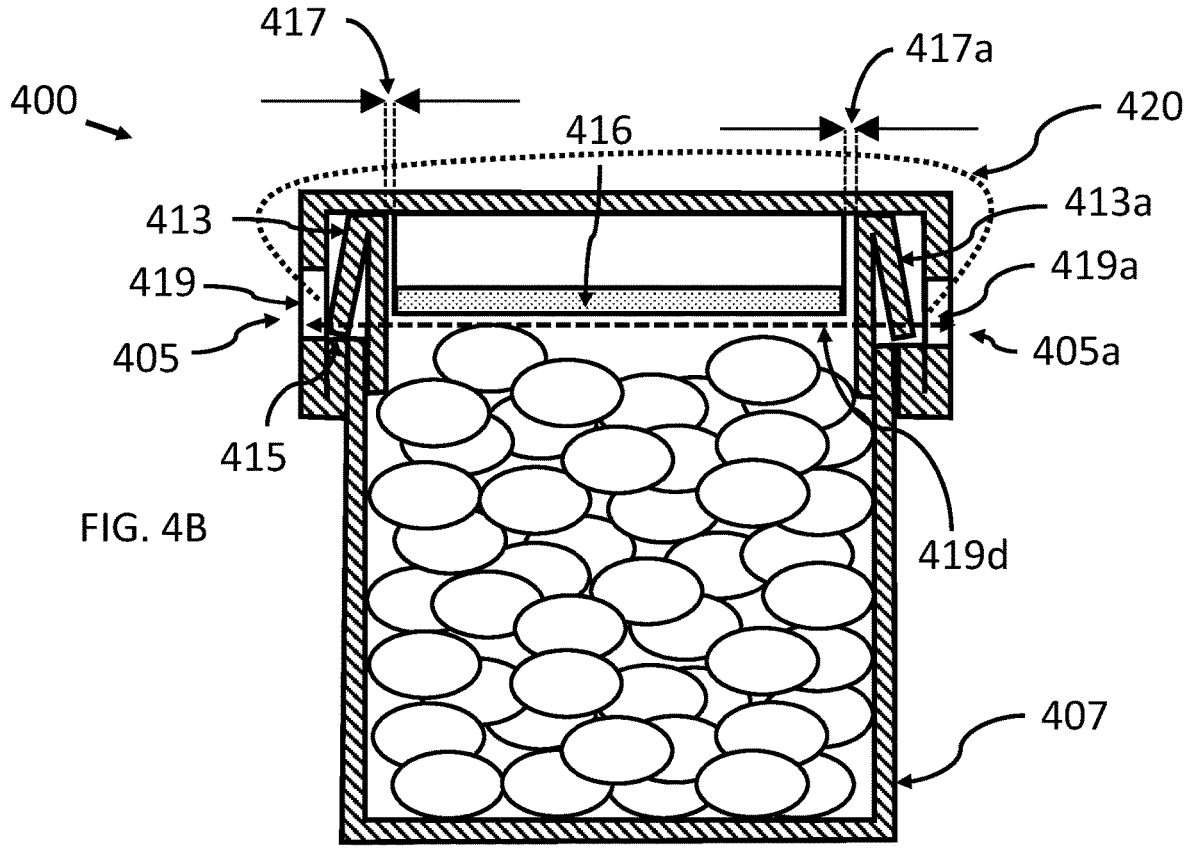

FIGS. 4A and 4B illustrate another example consumer product 400 according to this disclosure. FIG. 4A is a first cross section of the consumer product 400, 4B being a second cross section along cross section plane R of FIG. 4A. Consumer product 400 comprises a support element 416 which enters the opening with a shape having a triangular cross section in a plane, reproducing a shape similar to an inverted gable roof. The flanks in this example illustrated in FIGS. 4A and 4B are reinforced flanks similar in structure to the reinforced flanks illustrated in FIG. 3, differing from the flanks illustrated in FIG. 3 in that the locking tab 415 in the example illustrated in FIG. 4B correspond to an end of the reinforced section of the reinforced flank proximal to the top of the lid, whereas the locking tab was in the example illustrated in FIG. 3 corresponding to an aperture in the folded back flank section 310*b*. The sidewalls of the example consumer product 400 comprise a reinforced sidewall section 407*r* proximal to the opening. Indeed, in some example, at least a part of the sidewalls 407 comprises a reinforced sidewall section proximal to the opening. In this example, the reinforced sidewall section 407*r* comprises a main sidewall section 407*m* and a folded back sidewall section 407*b* lying flush against the main sidewall section, the main sidewall section 407*m* being hingedly connected to the folded back sidewall section 407*b* at an end distal from the base 406 of the box.

The example consumer product 400 comprises a lock 405 as illustrated in FIG. 4B. consumer product 400 also comprises an additional lock 405*a*. Indeed, in this example and in some other examples, the consumer product comprises an additional lock, the additional lock comprising an additional actuator connected to an additional specific portion of the sidewalls, the specific portion of the sidewalls being comprised in a first sidewall of the box, the additional specific portion of the sidewalls being comprised in a second sidewall of the box, the first sidewall being opposite to the second sidewall. The consumer product 400 comprises actuator 413 of the lock 405 and additional actuator 413*a* of lock 405*a*. It should be understood that in this example and in some other examples comprising an additional lock, such additional lock may have a structure similar to or different from the lock according to this disclosure. In some examples, the additional lock has a structure corresponding to the structure of the lock according to this disclosure. In some examples, the additional lock has a structure differing from to the structure of the lock according to this disclosure. In some examples, an additional lock is provided according to this disclosure on a same sidewall as the lock according to this disclosure. In some examples, an additional lock is provided on a sidewall adjacent to the sidewall comprising the lock.

In the example illustrated in FIG. 4B, the flanks comprise an actuation area 419 and an additional actuation area 419*b*. Indeed, in this example and in some other examples, the flanks comprise an actuation area facing the actuator and permitting displacing the actuator from the closing position to the opening position by applying the actuation pressure at the actuation area when the lid is in the closed position, whereby the actuation area comprises one or more of an actuation aperture, an actuation flap, an actuation slit or an actuation membrane, whereby the actuation area further comprises a visual indication indicating the location of the actuation area. In the example illustrated in FIG. 4B, the actuation areas 419 and 419*a* each comprise an actuation aperture. The visual indication may be printed on an external surface of the flanks and may comprise one or more arrows or one or more areas printed in a striking colour or a specific text providing instructions such as "push here to open" for example, or a combination of any of these indications.

In the example illustrated in FIG. 4B and in some other examples not illustrated here, the flanks comprise the additional actuation area 419*a* facing the additional actuator 413*a* and permitting displacing the additional actuator 413*a*, the actuation area 419 and the additional actuation area 419*a* being separated by a peripheral path 420 along an exterior surface of the lid, the peripheral path 420 measuring less than 20 cm and more than 9 cm. In some examples, this peripheral path is the shortest peripheral path between a top of the actuation area and a top of the additional actuation area, such top being a point of the respective actuation area or additional actuation area closest to the top of the lid. In some examples, the peripheral path 420 measures less than 15 cm and more than 11 cm. In some examples, the peripheral path 420 measures less than 14 cm and more than 12 cm. The length of such peripheral path may advantageously permit an adult user to apply a thumb of one hand on the actuator and the index (or middle finger) of the same one hand on the additional actuator at the same time in order to press on both the actuator additional and the additional actuator simultaneously with one hand in order to unlock the lid and open the lid. In other examples, two locks may be provided on a same sidewall, opening taking place by actuating on both locks, for examples using both thumbs.

In the example consumer product 400, actuation areas 419 and 419*a* are separated in a straight line from the outside surface of the respective flanks where they are located by a distance 419*d*, whereby such distance is of more than 6 cm and of less than 12 cm. In some examples, the distance 419*d* is of about 8 cm. In some examples, the distance 419*d* is of more than 7.5 cm and of less than 8.5 cm. In some examples, the distance 419*d* is of more than 8.4 cm and of less than 10.4 cm. In some examples, the distance 419*d* is of more than 8.9 cm and of less than 9.9 cm. In some examples, the distance 419*d* is of about 9.4 cm. In some examples, the clearance distances 417 and 417*a* are each of between 1 mm and 4 mm when no actuation pressure is applied. In some examples, the clearance distances 417 and 417*a* are each of between 3 mm and 4 mm when no actuation pressure is applied.

In the example illustrated in FIG. 4B, each lock is separated from a respective gable of the support element by a clearance distance, such as clearance distance 417 for lock 405 and clearance distance 417*a* for additional lock 405*a*. In this example and in some other examples according to this disclosure, the support element comprises a resilient structure concurrently in contact with both the specific portion and the additional specific portion when flexing of both the specific portion of the first sidewall and the additional specific portion of the second sidewall when the actuation pressure is applied above the pressure threshold on both the actuator and the additional actuator when the lid is in the closed position. In such a configuration the resilient structure of the actuator absorbs any excess pressure applied onto the actuators in order to open the lid. In some examples, the resilient structure is solid, for example made of a thermoplastic resin block. In some examples, the resilient structure comprises at least one cavity, for example in order to save material and lightweight the package. In some examples, the resilient structure is unitary, for example to facilitate manufacturing. Unitary should be understood as being made from an integral piece of material. In some examples, the resilient structure comprises a plurality of substructures, for example to facilitate assembly.

Figure 4C:
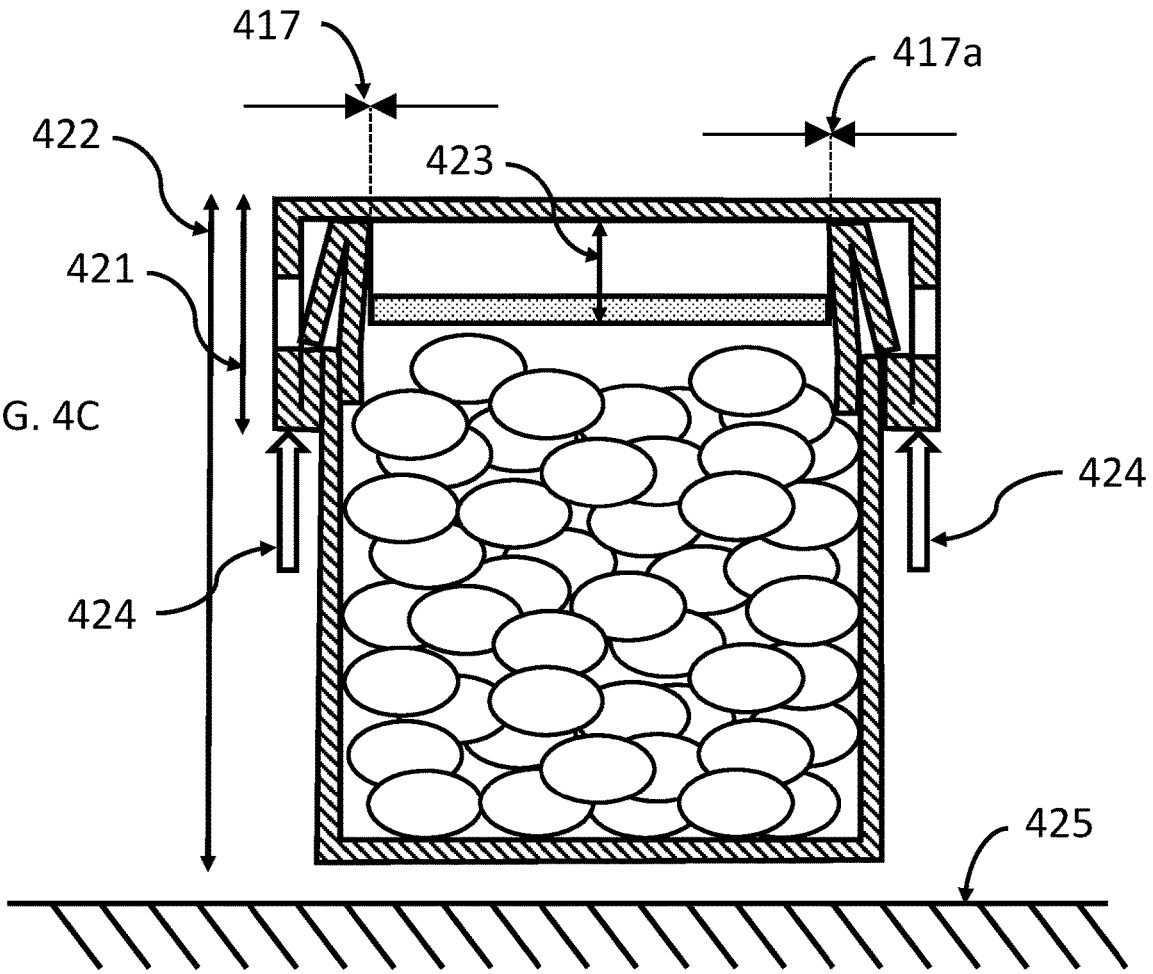

FIG. 4C represents the same consumer product example as represented in FIGS. 4B and 4A. As illustrated in FIG. 4C, the flanks cover about 30% of the sidewalls, 30% corresponding in this case to a ratio between on one hand a height 421 of the flanks in a direction normal to both the top of the lid and the base of the box and on the other hand the height of the sidewalls in the direction normal to both the top of the lid and the base of the box. In this example, the flanks completely surround the sidewalls around the opening. Such coverage of the flanks participates in ensuring lid placement, structural resiliency and protection of the content. In some examples, the flanks cover at least 30% of the sidewalls when the lid is in the closed position. In some examples, the flanks cover at least 35% of the sidewalls when the lid is in the closed position. In some examples, the flanks cover at least 40% of the sidewalls when the lid is in the closed position. In some examples, the flanks cover at most 90% of the sidewalls when the lid is in the closed position. In some examples, the flanks cover at most 80% of the sidewalls when the lid is in the closed position. In some examples, the flanks cover at most 70% of the sidewalls when the lid is in the closed position. In some examples, a manufacturing process comprises providing different box sizes, for example boxes having a sidewall height of either 10 cm, 11.5 cm, 13.5 cm or 16 cm, whereby each box may be provided with a same lid fitting all box sizes provided, such as a lid having a flank height of 7 cm. In some examples, flank height is of more than 3 cm. In some examples, flank height is of more than 5 cm. In some examples, flank height is of more than 6 cm.

As illustrated in the example of FIG. 4C, the support element comprises a support element distal end located when the lid is in the closed position at a certain depth 423. In some examples, the depth is of at least 3 mm and of less than 50 mm from the top of the lid. In some examples, the depth is of at least 5 mm and of less than 50 mm from the top of the lid. In some examples, the depth is of at least 15 mm and of less than 40 mm from the top of the lid. In some examples, the depth is of at least 20 mm and of less than 35 mm from the top of the lid. The depth of the support element participates in reinforcing the structure of the consumer product. A combination of the depth and shape of the support element as well as amount of clearance distance may permit avoiding twisting the lid.

In FIG. 4C the consumer product of FIGS. 4A and 4B is illustrated in a situation whereby a force is applied to the flanks in a direction normal to the base of the box, in a direction from the base of the box and towards the top of the lid. Such force may be applied for example when lifting the box from a floor 425 to transport it. As illustrated in FIG. 4C, in such a situation the clearance distances 417 and 417*a* may be reduced to zero due to the weight of the content and of the box being applied to the locking tabs through the actuators. In such a situation, the support element permits avoiding accidental opening of the box due to sidewalls sinking in to a point that the actuators would be released from the locking tab, the box falling on the floor, the lid remaining in the hands of the person lifting the box by holding it by the lid. In this example and in some other examples, the detergent product weights more than 50% of the weight of the consumer product, whereby a gravity force produced on the base of the box by the detergent product in the absence of a reaction force on the base of the box produces a flexing of the specific portion of the sidewalls and a reduction of the clearance to zero, the actuator maintaining abutment against the locking tab when the clearance is reduced to zero and when no actuation pressure is applied. In some examples, the detergent product weights more than 70% of the weight of the consumer product in such a situation. In some examples, the detergent product weights more than 80% of the weight of the consumer product in such a situation.

Figure 4D:
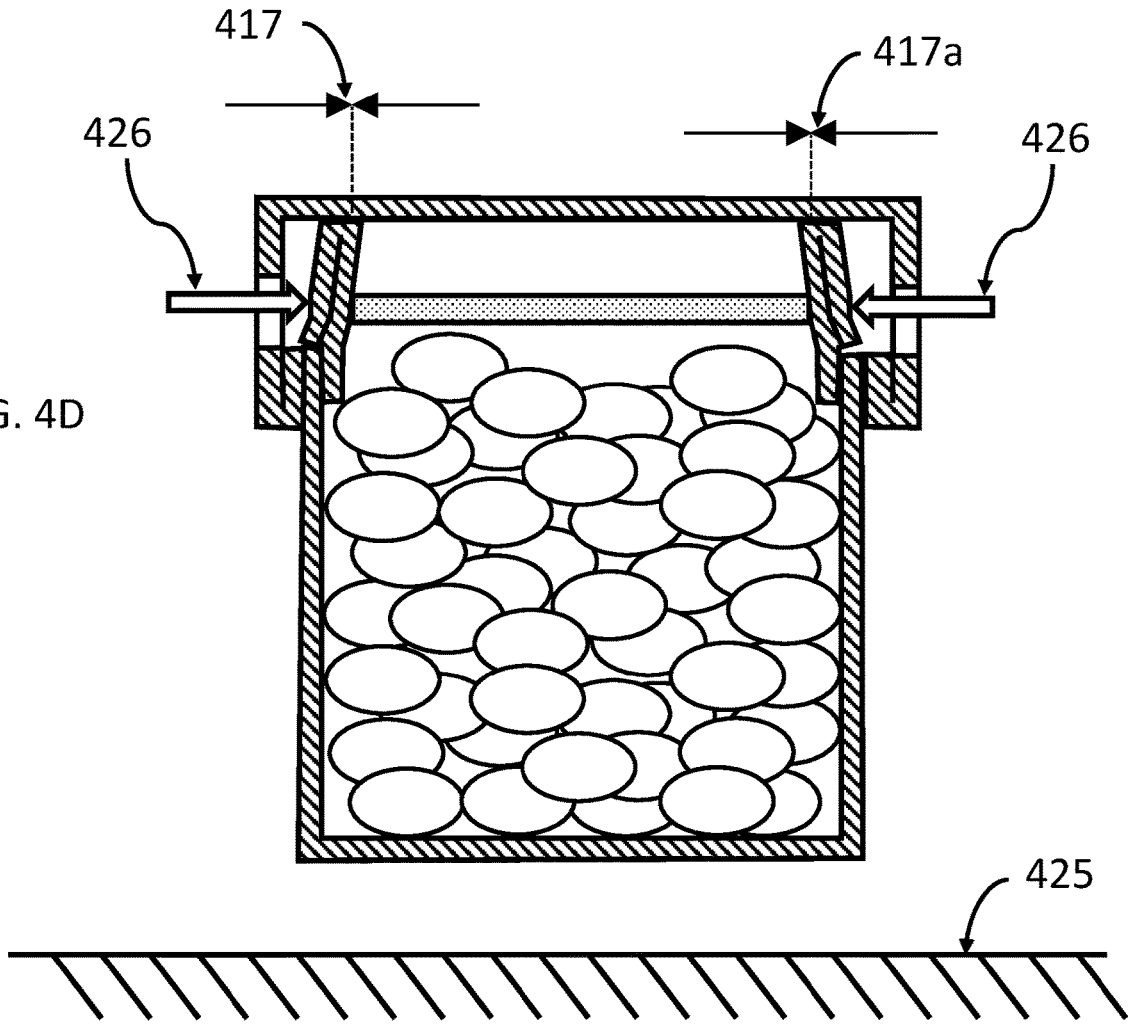

In FIG. 4D the consumer product of FIGS. 4A-C is illustrated in a situation whereby a force 426 is applied to the actuators in a direction normal to the sidewalls, in a direction towards the inside of the box, for example by gripping the lid with one hand, a thumb on one side and the other fingers on the other. Such force 426 may be applied for example when lifting the box from a floor 425 to transport it. As illustrated in FIG. 4D, in such a situation the clearance distances 417 and 417*a* may be reduced to zero due to the force 426 sandwiching the sidewalls between the support element and the actuators. In such a situation, the static friction force between the side walls and the support element permits avoiding accidental opening of the box due to the lid getting disconnected from the sidewalls, the box falling on the floor, the lid remaining in the hand of the person lifting the bow by holding it by the lid.

Figure 5A:
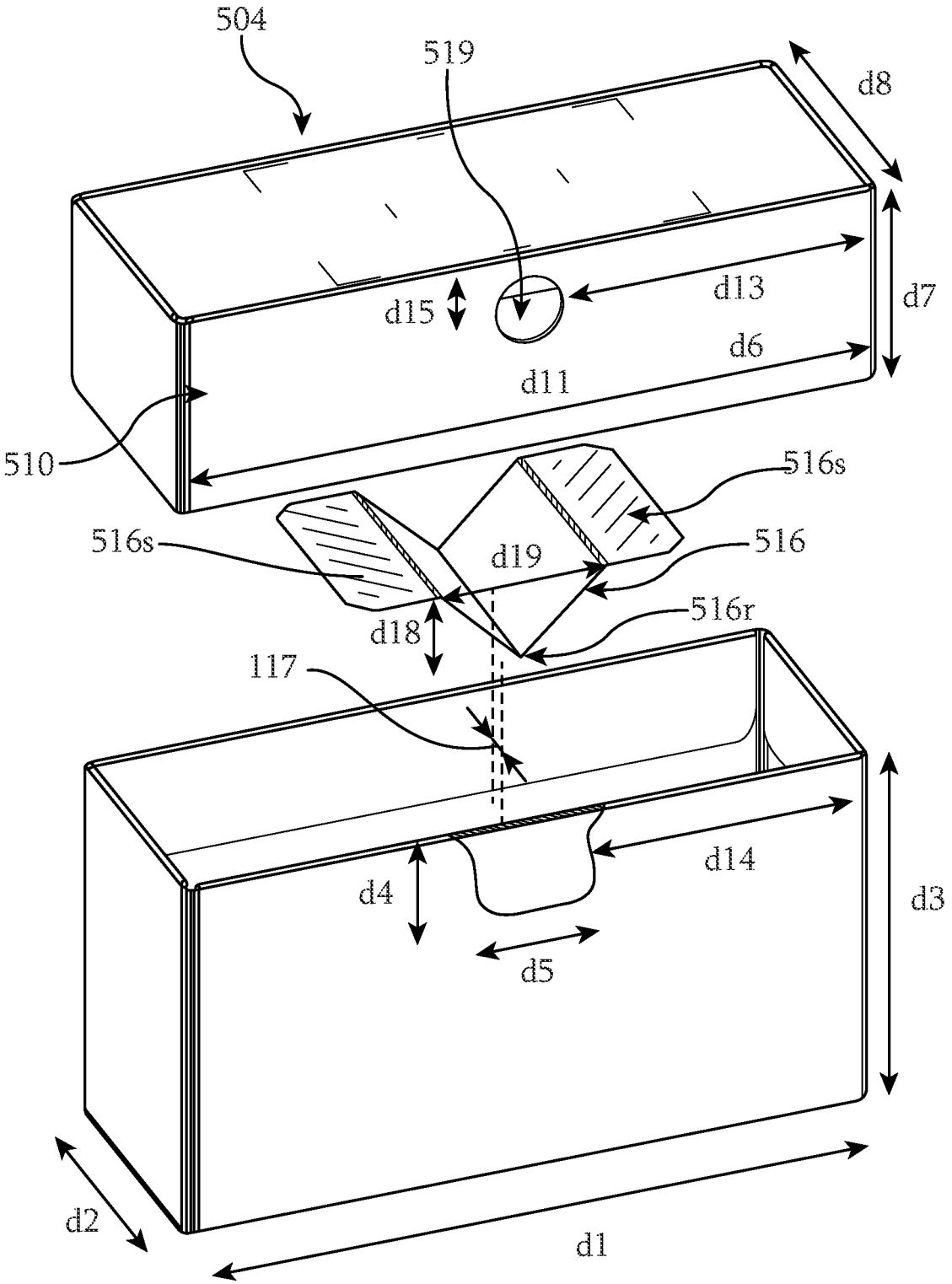
FIG. 5A-B illustrate yet a further example product.
Figure 5B:
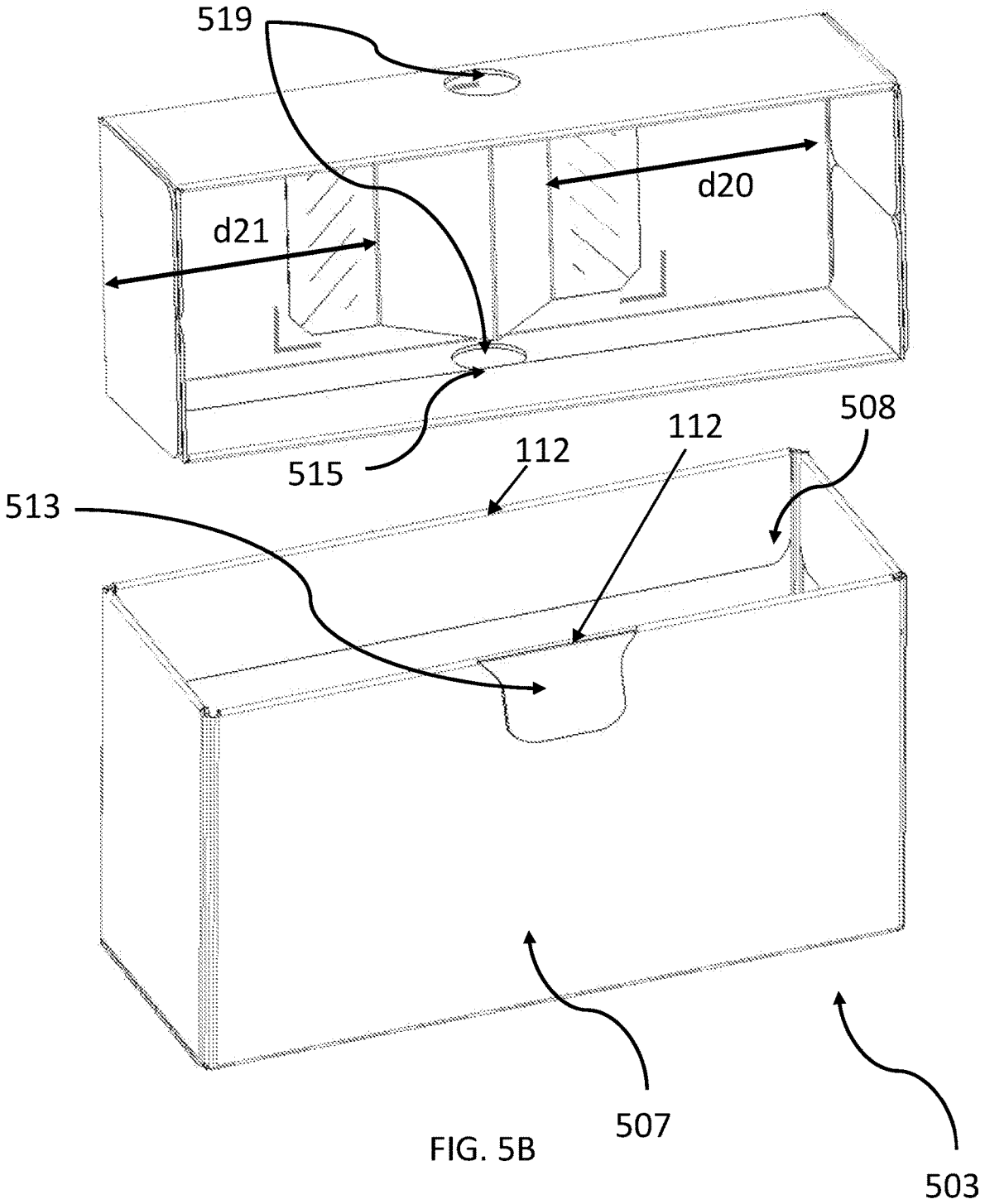

FIGS. 5A-B illustrate a further example of a consumer product according to this disclosure. In this example, the container is made from paper or cardboard materials and is thereby made from materials which may be recycled. In FIG. 5A, such example is represented in an exploded view, the support element 516 having an inverted gable roof shape and comprising side flaps 516*s* which may be glued to the top of the lid 504 in order to connect the support element to the lid 504. The same example is illustrated in FIG. 5B with the support element 516 affixed to the inside of the top of the lid. When affixed to the top of the lid, the gable shape support element 516 has a ridge 516*r* which faces apertures 519 in opposite reinforced flanks 510 of the lid. When the lid is placed in a closed position (not illustrated), the ridge 516*r* and apertures 159 are aligned with actuator flaps 513, one of which is located on a first sidewall 507 of the box 503, the other actuator flap or additional actuator flap being located on another sidewall facing the first sidewall 507 and not being illustrated here. In this example, the sidewalls of the box and the flanks of the lid are reinforced, reinforcement being provided by sections of the sidewalls or flanks being folded back. In some examples, reinforcement is provided by gluing a separate piece at the reinforced area. Actuator flap 513 is in this example formed by cutting out a main layer of sidewall 507, flap 513 being linked to the side wall by a hinge coinciding with a portion of the periphery of the opening 508 of the box. When the lid is placed in the closed position, flap 513 and the corresponding flap of the additional actuator engage a locking tab and, respectively, additional locking tab 515 which are formed by the reinforced section of the flanks of the lid. In FIG. 5B, the flap 513 would engage with a locking tab which is not illustrated due to the position of the lid on the figure, and the additional flap, not illustrated, would engage with the illustrated additional locking tab 515.

The example illustrated in FIGS. 5A-B was realized using the following dimensions:

| Dimension | mm | Description |
|---|---|---|
| d1 | 239 | Box length |
| d2 | 88 | Box width |
| d3 | 133 | Box height |
| d4 | 30 | Flap height |
| d5 | 40 | Flap breadth |
| d6 | 245 | Lid length |
| d7 | 70 | Lid height |
| d8 | 94 | Lid width |

-continued

| Dimension | mm | Description |
|---|---|---|
| d11 (diameter) | 24 | Aperture diameter |
| d13 | 120 | From aperture edge to flank edge |
| d14 | 98 | From flap edge to box edge |
| d15 | 19 | From lid top edge to aperture center |
| d17 | 1 | Clearance without actuation pressure (not illustrated) |
| d18 | 21 | From support element ridge to top of lid |
| d19 | 70 | Support element gable basis |
| d20 | 85 | From first gable base to first top lid edge |
| d21 | 85 | From second gable base to second top lid edge |

The consumer product as illustrated in FIGS. 5A-B was submitted to the following experimental process cycle. The consumer product is filled with detergent product, in this case 40 water soluble unit dose detergent articles, each article weighing 28 grams, summing 1120 grams for the 40 articles, and lifted from a table to a height of 50 cm above the table within a timeframe of 1 second. The lid, box and support element forming the container as illustrated in FIGS. 5A-B weighs 151 grams. The consumer product is held for 1 second at the 50 cm height prior to re-placing the product container on the table, again within a 1 second timeframe. The total experimental time of such a cycle was 3 seconds. Each cycle was repeated 10 times. The consumer product according to this example was successfully re-placed on the table for all 10 replicates. This experiment was repeated with a same consumer product without support element. In the case of the consumer product without support element, the box got disconnected from the lid and fell on the table from the 50 cm height within every single cycle, spilling the enclosed water soluble unit dose detergent articles over the table.

In some examples, the consumer product comprises at least one water-soluble unit dose article and the container. The consumer product can be sold 'as is', in other words the consumer product is the item that the consumer picks up from the shelf. Alternatively, the consumer product could be housed as one unit of a multi-component product. For example, more than one consumer product could be housed within an outer package and the multiple packaged consumer products sold together in a single purchase. The consumer product may comprise aesthetic elements, for example shrink sleeves or labels attached to the container. Alternatively, the container may be coloured or printed with aesthetic elements or informative print such as usage instructions.

In some examples a water-soluble unit dose article comprises at least one water-soluble film orientated to create at least one unit dose internal compartment, wherein the at least one unit dose internal compartment comprises a detergent composition. The water-soluble film and the detergent composition are described in more detail below. In some examples the consumer product comprises at least one water-soluble unit dose article, in some cases at least two water-soluble unit dose articles, in some cases at least 10 water-soluble unit dose articles, in some cases at least 20 water-soluble unit dose articles, in some cases at least 30 water-soluble unit dose articles, in some cases at least 40 water-soluble unit dose articles, in some cases at least 45 water-soluble unit dose articles. A water-soluble unit dose article is in some examples in the form of a pouch. A water-soluble unit dose article comprises in some examples a unitary dose of a composition as a volume sufficient to provide a benefit in an end application. The water-soluble unit dose article comprises in some examples one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor. The unit dose article may comprise more than one compartment, at least two compartments, or at least three compartments, or at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment. In some examples the unit dose article comprises at least two compartments, one of the compartments being smaller than the other compartment. In some examples the unit dose article comprises at least three compartments, two of the compartments may be smaller than the third compartment, and in some examples the smaller compartments being superposed on the larger compartment. The superposed compartments are in some examples orientated side-by-side. In some examples each individual unit dose article may have a weight of between 10 g and 40 g, or even between 15 g and 35 g. The water soluble film may be soluble or dispersible in water. Prior to be being formed into a unit dose article, the water-soluble film has in some examples a thickness of from 20 to 150 micron, in other examples 35 to 125 micron, in further examples 50 to 110 micron, in yet further examples about 76 micron. Example water soluble film materials comprise polymeric materials. The film material can, for example, be obtained by casting, blow-moulding, extrusion or blown extrusion of the polymeric material. In some examples, the water-soluble film comprises polyvinyl alcohol polymer or copolymer, for example a blend of polyvinylalcohol polymers and/or polyvinylalcohol copolymers, for example selected from sulphonated and carboxylated anionic polyvinylalcohol copolymers especially carboxylated anionic polyvinylalcohol copolymers, for example a blend of a polyvinylalcohol homopolymer and a carboxylated anionic polyvinylalcohol copolymer. In some examples water soluble films are those supplied by Monosol under the trade references M8630, M8900, M8779, M8310. In some examples the film may be opaque, transparent or translucent. The film may comprise a printed area. The area of print may be achieved using techniques such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Example levels of aversive agent include, but are not limited to, 1 to 5000 ppm, 100 to 2500 ppm, or 250 to 2000 ppm. The water-soluble film or water-soluble unit dose article or both may be coated with a lubricating agent. In some examples, the lubricating agent is selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

In some examples the container comprises a first part, wherein the first part comprises a first compartment in which the at least one water-soluble unit dose article is contained. In some examples the first compartment comprises at least two water-soluble unit dose articles. The first compartment may comprise between 1 and 80 water-soluble unit dose articles, between 1 and 60 water-soluble unit dose articles, between 1 and 40 water-soluble unit dose articles, or between 1 and 20 water-soluble unit dose articles. The volume of the first compartment may be between 500 ml and 5000 ml, in some examples between 800 ml and 4000 ml.

In some examples the detergent product comprises a detergent composition. The detergent composition may be a laundry detergent composition, an automatic dishwashing composition, a hard surface cleaning composition, or a combination thereof. The detergent composition may comprise a solid, a liquid or a mixture thereof. The term liquid includes a gel, a solution, a dispersion, a paste, or a mixture thereof. The solid may be a powder. By powder we herein mean that the detergent composition may comprise solid particulates or may be a single homogenous solid. In some examples, the powder detergent composition comprises particles. This means that the powder detergent composition comprises individual solid particles as opposed to the solid being a single homogenous solid. The particles may be free-flowing or may be compacted. A laundry detergent composition can be used in a fabric hand wash operation or may be used in an automatic machine fabric wash operation, for example in an automatic machine fabric wash operation. Example laundry detergent compositions comprise a non-soap surfactant, wherein the non-soap surfactant comprises an anionic non-soap surfactant and a non-ionic surfactant. In some examples, the laundry detergent composition comprises between 10% and 60%, or between 20% and 55% by weight of the laundry detergent composition of the non-soap surfactant. Example weight ratio of non-soap anionic surfactant to nonionic surfactant are from 1:1 to 20:1, from 1.5:1 to 17.5:1, from 2:1 to 15:1, or from 2.5:1 to 13:1. Example non-soap anionic surfactants comprises linear alkylbenzene sulphonate, alkyl sulphate or a mixture thereof. Example weight ratio of linear alkylbenzene sulphonate to alkyl sulphate are from 1:2 to 9:1, from 1:1 to 7:1, from 1:1 to 5:1, or from 1:1 to 4:1. Example linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear. Example alkyl sulphate anionic surfactant may comprise alkoxylated alkyl sulphate or non-alkoxylated alkyl sulphate or a mixture thereof. Example alkoxylated alkyl sulphate anionic surfactant comprise an ethoxylated alkyl sulphate anionic surfactant. Example alkyl sulphate anionic surfactant may comprise an ethoxylated alkyl sulphate anionic surfactant with a mol average degree of ethoxylation from 1 to 5, from 1 to 3, or from 2 to 3. Example alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5, from 1 to 3, or from 2 to 3. Example alkyl fraction of the alkyl sulphate anionic surfactant are derived from fatty alcohols, oxo-synthesized alcohols, Guerbet alcohols, or mixtures thereof. In some examples, the laundry detergent composition comprises between 10% and 50%, between 15% and 45%, between 20% and 40%, or between 30% and 40% by weight of the laundry detergent composition of the non-soap anionic surfactant. In some examples, the non-ionic surfactant is selected from alcohol alkoxylate, an oxo-synthesised alcohol alkoxylate, Guerbet alcohol alkoxylates, alkyl phenol alcohol alkoxylates, or a mixture thereof. In some examples, the laundry detergent composition comprises between 0.01% and 10%, between 0.01% and 8%, between 0.1% and 6%, or between 0.15% and 5% by weight of the liquid laundry detergent composition of a non-ionic surfactant. In some examples, the laundry detergent composition comprises between 1.5% and 20%, between 2% and 15%, between 3% and 10%, or between 4% and 8% by weight of the laundry detergent composition of soap, in some examples a fatty acid salt, in some examples an amine neutralized fatty acid salt, wherein in some examples the amine is an alkanolamine for example selected from monoethanolamine, diethanolamine, triethanolamine or a mixture thereof, in some examples monoethanolamine. In some examples, the laundry detergent composition is a liquid laundry detergent composition. In some examples the liquid laundry detergent composition comprises less than 15%, or less than 12% by weight of the liquid laundry detergent composition of water. In some examples, the laundry detergent composition is a liquid laundry detergent composition comprising a non-aqueous solvent selected from 1,2-propanediol, dipropylene glycol, tripropyleneglycol, glycerol, sorbitol, polyethylene glycol or a mixture thereof. In some examples, the liquid laundry detergent composition comprises between 10% and 40%, or between 15% and 30% by weight of the liquid laundry detergent composition of the non-aqueous solvent. In some examples, the laundry detergent composition comprises a perfume. In some examples, the laundry detergent composition comprises an adjunct ingredient selected from the group comprising builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof. In some examples, the laundry detergent composition has a pH between 6 and 10, between 6.5 and 8.9, or between 7 and 8, wherein the pH of the laundry detergent composition is measured as a 10% product concentration in demineralized water at 20° C. When liquid, the laundry detergent composition may be Newtonian or non-Newtonian. In some examples, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution. The liquid laundry detergent composition described herein can have any suitable viscosity depending on factors such as formulated ingredients and purpose of the composition.

In some examples, the box is constructed from a first blank and the lid is constructed from a second blank. In some examples the support element is glued into the lid part.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A consumer product comprising a detergent product and a container, the container comprising a box, a lid for the box, and a lock to maintain the lid in a closed position, the box comprising the detergent product, the box comprising a base, sidewalls and an opening opposite the base, the lid comprising a top and flanks, the top covering the opening and at least a portion of the flanks covering at least a specific portion of the sidewalls when the lid is in the closed position, the lid being moveable from the closed position to an open position, the lock comprising an actuator moveable from a locking position to an opening position by applying an actuation pressure onto the actuator when the lid is in the closed position, wherein the actuator is resilient in that the actuator comprises a flexible element, the flexible element having a default position corresponding to the lid remaining closed, the flexible element being pressed to open the lid, the flexible element springing back to the default position when releasing pressure, wherein the lid further comprises a support element, the support element entering the opening when the lid is in the closed position, at least part of the specific portion of the sidewalls being located between the flanks and the support element when the lid is in the closed position, a clearance distance separating the sidewalls from the support element in a direction normal to the specific portion of the sidewalls when the lid is in the closed position and when no actuation pressure is applied.

2. The consumer product according to claim 1, wherein the clearance distance is of at least 1 mm and of less than 1 cm when the lid is in the closed position and no actuation pressure is applied.

3. The consumer product according to claim 1, wherein the actuator is connected to the specific portion of the sidewalls, the actuator abutting against a locking tab of the flanks when in the locking position, the actuator being maintained away from the locking tab when in the opening position, the actuator being displaceable by the actuation pressure by an unlocking displacement distance in a direction normal to the specific portion of the sidewalls.

4. The consumer product according to claim 1, wherein the actuator comprises a flap connected by a hinge portion to the specific portion of the sidewalls, the flap extending from the hinge portion to a distal edge of the flap, the hinge portion being located between the flanks and the support element when the lid is in the closed position, the distal edge extending away from the specific portion of the sidewalls and the distal edge of the flap abutting against the locking tab of the flanks when in the locking position, the flap lying flush against the specific portion of the sidewalls and the distal edge being maintained away from the locking tab when in the opening position, the flap displaced by an acute actuation angle from the closing position to the opening position, the acute angle corresponding to displacement of the distal edge by an unlocking displacement distance.

5. The consumer product according to claim 1, wherein the support element comprises a support area, the support area comprising an area of contact with the specific portion of the sidewall when the clearance distance is reduced to zero by flexing of the specific portion of the sidewalls when the actuation pressure is applied above a pressure threshold when the lid is in the closed position, wherein the area of contact faces the actuator along a direction normal to the specific portion of the sidewalls.

6. The consumer product according to claim 1, wherein at least a part of the flanks comprises a reinforced flank section.

7. The consumer product according to claim 6, wherein the reinforced flank section comprises the locking tab.

8. The consumer product according to claim 6, wherein the reinforced flank section comprises a main flank section and a folded back flank section lying flush against the main flank section, the main flank section being hingedly connected to the folded back flank section at an end of the reinforced flank section distal from the top of the lid.

9. The consumer product according to claim 1, wherein at least a part of the sidewalls comprise a reinforced sidewall section proximal to the opening.

10. The consumer product according to claim 9, wherein the reinforced sidewall section comprises a main sidewall section and a folded back sidewall section lying flush against the main sidewall section, the main sidewall section being hingedly connected to the folded back sidewall section at an end distal from the base of the box.

11. The consumer product according to claim 1, wherein the consumer product comprises an additional lock, the additional lock comprising an additional actuator connected to an additional specific portion of the sidewalls, the specific portion of the sidewalls being comprised in a first sidewall of the box, the additional specific portion of the sidewalls being comprised in a second sidewall of the box, the first sidewall being opposite to the second sidewall.

12. The consumer product according to claim 11, wherein the flanks comprise an additional actuation area facing the additional actuator and permitting displacement of the additional actuator, the actuation area and the additional actuation area being separated by a peripheral path along an exterior surface of the lid, the peripheral path measuring less than 20 cm and more than 9 cm.

13. The consumer product according to claim 11, wherein the support element comprises a resilient structure concurrently in contact with both the specific portion and the additional specific portion when flexing of both the specific portion of the first sidewall and the additional specific portion of the second sidewall when the actuation pressure is applied above a pressure threshold on both the actuator and the additional actuator when the lid is in the closed position.

14. The consumer product according to any one of claim 13, wherein the resilient structure is unitary.

15. The consumer product according to claim 1, wherein the flanks comprise an actuation area facing the actuator and permitting displacement of the actuator from the closing position to the opening position by applying the actuation pressure at the actuation area when the lid is in the closed position, wherein the actuation area comprises one or more of an actuation aperture, an actuation flap, an actuation slit or an actuation membrane, wherein the actuation area further comprises a visual indication indicating the location of the actuation area.

16. The consumer product according to claim 1, wherein the container is made from paper or cardboard materials.

17. The consumer product according to claim 1, wherein the flanks cover at least 30% of the sidewalls when the lid is in the closed position.

18. The consumer product according to claim 1, wherein the support element comprises a support element distal end located at a depth of at least 3 mm and of less than 50 mm from the top of the lid when the lid is in the closed position.

19. The consumer product according to claim 1, wherein the clearance distance is reduced to zero by flexing of the specific portion of the sidewalls when the actuation pressure is applied above a pressure threshold when the lid is in the closed position.

20. The consumer product according to claim 1, wherein the detergent product weighs more than 50% of the weight of the consumer product, wherein a gravity force produced on the base of the box by the detergent product in the absence of a reaction force on the base of the box produces a flexing of the specific portion of the sidewalls and a reduction of the clearance to zero, the actuator maintaining abutment against the locking tab when the clearance is reduced to zero and when no actuation pressure is applied.

* * * * *